US011332329B2

(12) United States Patent
Shimosaka et al.

(10) Patent No.: US 11,332,329 B2
(45) Date of Patent: May 17, 2022

(54) MEDIUM CONVEYING APPARATUS INCLUDING SIDE GUIDES WHICH CAN BE POSITIONED OUTSIDE MEDIUM TRAY

(71) Applicant: PFU LIMITED, Kahoku (JP)

(72) Inventors: Kiichiro Shimosaka, Kahoku (JP); Yoshito Hirai, Kahoku (JP); Norihiro Takayama, Kahoku (JP)

(73) Assignee: PFU LIMITED, Kahoku (JP)

( * ) Notice: Subject to any disclaimer, the term of this patent is extended or adjusted under 35 U.S.C. 154(b) by 17 days.

(21) Appl. No.: 17/099,599

(22) Filed: Nov. 16, 2020

(65) Prior Publication Data

US 2021/0188573 A1 Jun. 24, 2021

(30) Foreign Application Priority Data

Dec. 19, 2019 (JP) ..... JP2019-229573

(51) Int. Cl.
*B65H 1/04* (2006.01)
*B65H 1/02* (2006.01)
*B65H 31/20* (2006.01)

(52) U.S. Cl.
CPC ..... *B65H 1/02* (2013.01); *B65H 1/04* (2013.01); *B65H 31/20* (2013.01); *B65H 2402/64* (2013.01); *B65H 2511/12* (2013.01); *B65H 2511/20* (2013.01); *B65H 2511/22* (2013.01); *B65H 2801/39* (2013.01)

(58) Field of Classification Search
CPC ..... B65H 2511/12; B65H 2402/64; B65H 2403/411; B65H 2405/1142; B65H 2405/11425; B65H 2405/1144; G03G 15/6514; G03G 15/607
USPC ..... 271/171
See application file for complete search history.

(56) References Cited

U.S. PATENT DOCUMENTS

| | | | | |
|---|---|---|---|---|
| 7,984,903 | B2 * | 7/2011 | Coret | B65H 1/06 271/171 |
| 9,469,493 | B2 | 10/2016 | Chen et al. | |
| 2007/0020007 | A1 * | 1/2007 | Azuma | G03G 15/607 399/367 |
| 2011/0127714 | A1 * | 6/2011 | Kuo | B65H 1/00 271/171 |
| 2013/0056925 | A1 * | 3/2013 | Hsu | B65H 1/04 271/171 |

FOREIGN PATENT DOCUMENTS

| | | |
|---|---|---|
| JP | 4958646 B2 | 3/2012 |
| JP | 5692820 B2 | 2/2015 |

* cited by examiner

*Primary Examiner* — Jeremy R Severson
(74) *Attorney, Agent, or Firm* — Lewis Rothgerber Christie LLP

(57) ABSTRACT

A medium conveying apparatus includes a medium tray, a pair of side guides to regulate a width direction of a medium, and a housing on which the medium tray is located and including a conveyance path capable of conveying the medium placed on the medium tray. The pair of side guides are located on the medium tray so that outer ends of the pair of side guides can be positioned from an inside of the medium tray to an outside of a maximum width of the medium tray. The conveyance path can convey a medium having a width of an inside of the pair of side guides even when the outer ends of the pair of side guides are positioned outside the maximum width of the medium tray.

11 Claims, 15 Drawing Sheets

MEDIUM CONVEYING APPARATUS INCLUDING SIDE GUIDES WHICH CAN BE POSITIONED OUTSIDE MEDIUM TRAY

CROSS-REFERENCE TO RELATED APPLICATIONS

This application is based upon and claims the benefit of priority of prior Japanese Patent Application No. 2019-229573, filed on Dec. 19, 2019, the entire contents of which are incorporated herein by reference.

TECHNICAL FIELD

Embodiments discussed in the present specification relate to medium conveyance.

BACKGROUND

In recent years, a medium conveying apparatus such as a scanner, is required to convey and image not only a medium of a standard size such as A-size, B-size or legal-size, etc., but also a medium of a unique size used by each user. When the medium conveying apparatus supports a medium of a unique size larger than the standard size, it is necessary to increase the size of a medium tray to place a medium, thereby, the apparatus size and the apparatus weight are increased. On the other hand, for customers who do not need to support a medium of such unique size, it is preferable that the apparatus size and the apparatus weight of the media conveying apparatus are as small as possible, and it is undesirable that the apparatus size and the apparatus weight of the media conveying apparatus are increased.

A sheet feeding device including a first regulating member and a second regulating member to regulate a placing position of a sheet in a width direction, which can adjust the placing position, and an interlocking mechanism of the first regulating member and the second regulating member, is disclosed (Japanese patent publication No. 4958646).

A sheet loading apparatus including a tray to load a sheet, a pair of width regulating member to regulate a width direction of the sheet, and a hole provided for engaging an auxiliary regulating member to regulate a range of a movement of the width regulating member, is disclosed (Japanese patent publication No. 5692820).

SUMMARY

According to some embodiments, a medium conveying apparatus includes a medium tray, a pair of side guides to regulate a width direction of a medium, and a housing on which the medium tray is located and including a conveyance path capable of conveying the medium placed on the medium tray. The pair of side guides are located on the medium tray so that outer ends of the pair of side guides can be positioned from an inside of the medium tray to an outside of a maximum width of the medium tray. The conveyance path can convey a medium having a width of an inside of the pair of side guides even when the outer ends of the pair of side guides are positioned outside maximum width of the medium tray.

DESCRIPTION OF EMBODIMENTS

It is to be understood that both the foregoing general description and the following detailed description are exemplary and explanatory, and are not restrictive of the invention, as claimed.

Hereinafter, a medium conveying apparatus according to an embodiment, will be described with reference to the drawings. However, it should be noted that the technical scope of the invention is not limited to these embodiments, and extends to the inventions described in the claims and their equivalents.

Figure 1:
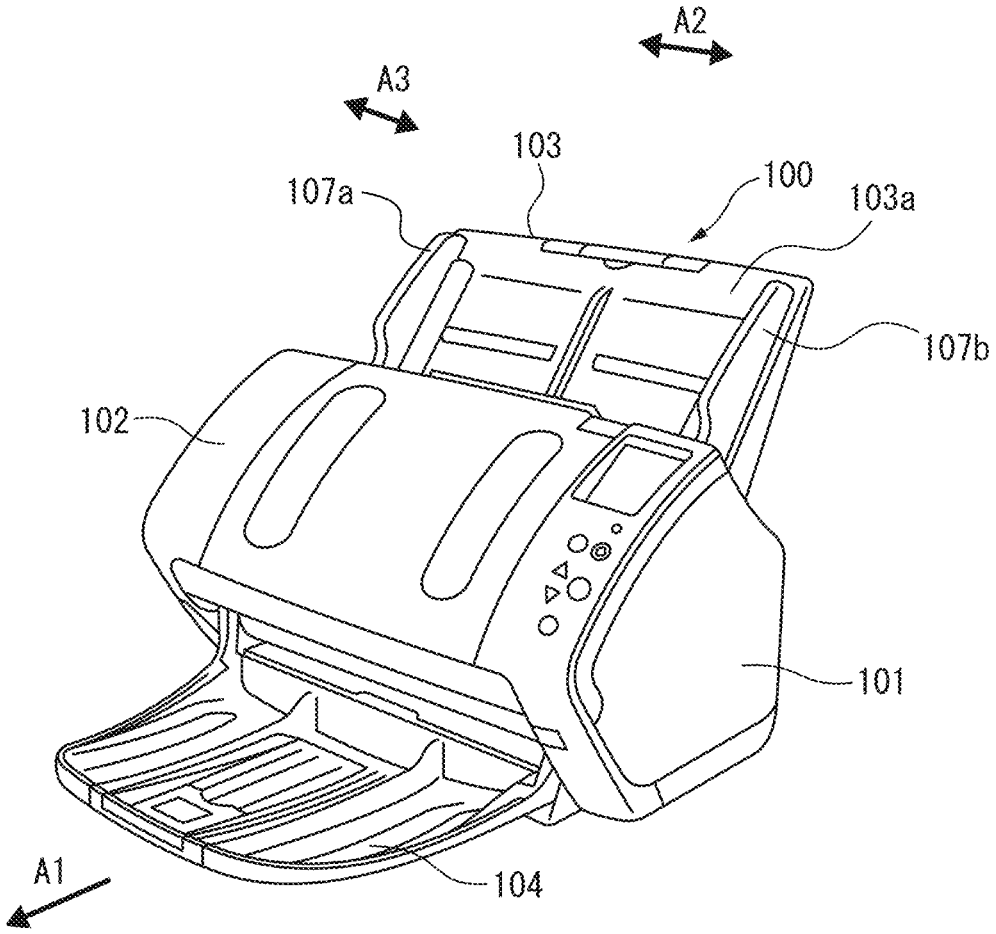
FIG. 1 is a perspective view illustrating a medium conveying apparatus 100 according to an embodiment.

FIG. 1 is a perspective view illustrating a medium conveying apparatus 100 configured as an image scanner. The medium conveying apparatus 100 conveys and images a medium being a document. A medium is a paper, a thick paper, a plastic card, a booklet or a passport, etc. The paper includes a paper of a standard size such as A-size, B-size or legal-size, etc., and a paper of a unique size used by each user. The paper of the unique size, for example, includes a first region of a fixed size in which predetermined information is described, and a second region including sprocket holes provided on both sides of the first region. The medium conveying apparatus 100 may be a fax machine, a copying machine, a multifunctional peripheral (MFP), etc. A conveyed medium may not be a document but may be an object being printed on etc., and the medium conveying apparatus 100 may be a printer etc.

The medium conveying apparatus 100 includes a lower housing 101, an upper housing 102, a medium tray 103, and an ejection tray 104, etc. An arrow A1 in FIG. 1 indicates a medium conveying direction. An upstream hereinafter refers to an upstream in the medium conveying direction A1, and a downstream refers to a downstream in the medium conveying direction A1.

The upper housing 102 is located at a position covering the upper surface of the medium conveying apparatus 100 and is engaged with the lower housing 101 by hinges so as to be opened and closed at a time of medium jam, during cleaning the inside of the medium conveying apparatus 100, etc. The lower housing 101 and the upper housing 102 are an example of a housing.

The medium tray 103 is located on the lower housing 101 so as to engage with the lower housing 101 in such a way as to be able to place a medium to be conveyed. The medium tray 103 has a placing surface 103*a* on which the medium is mounted, and a first side guide 107*a* and a second side guide 107*b* are provided on the placing surface 103*a*. The first, second side guides 107*a*, 107*b* are an example of a pair of side guides. Hereinafter, the first, second side guides 107*a*, 107*b* may be collectively referred to as the side guides 107. Each of the side guides 107 is movably provided in conjunction with each other in a width direction A2 perpendicular to a medium conveying direction on the medium tray 103. Each of the side guides 107 may be provided so as to move independently. Each of the side guides 107 has a predetermined height in a height direction A3, and regulates the width direction of the medium placed on the medium tray 103. The ejection tray 104 is engaged with the lower housing 101 in such a way as to be able to hold an ejected medium.

Figure 2:
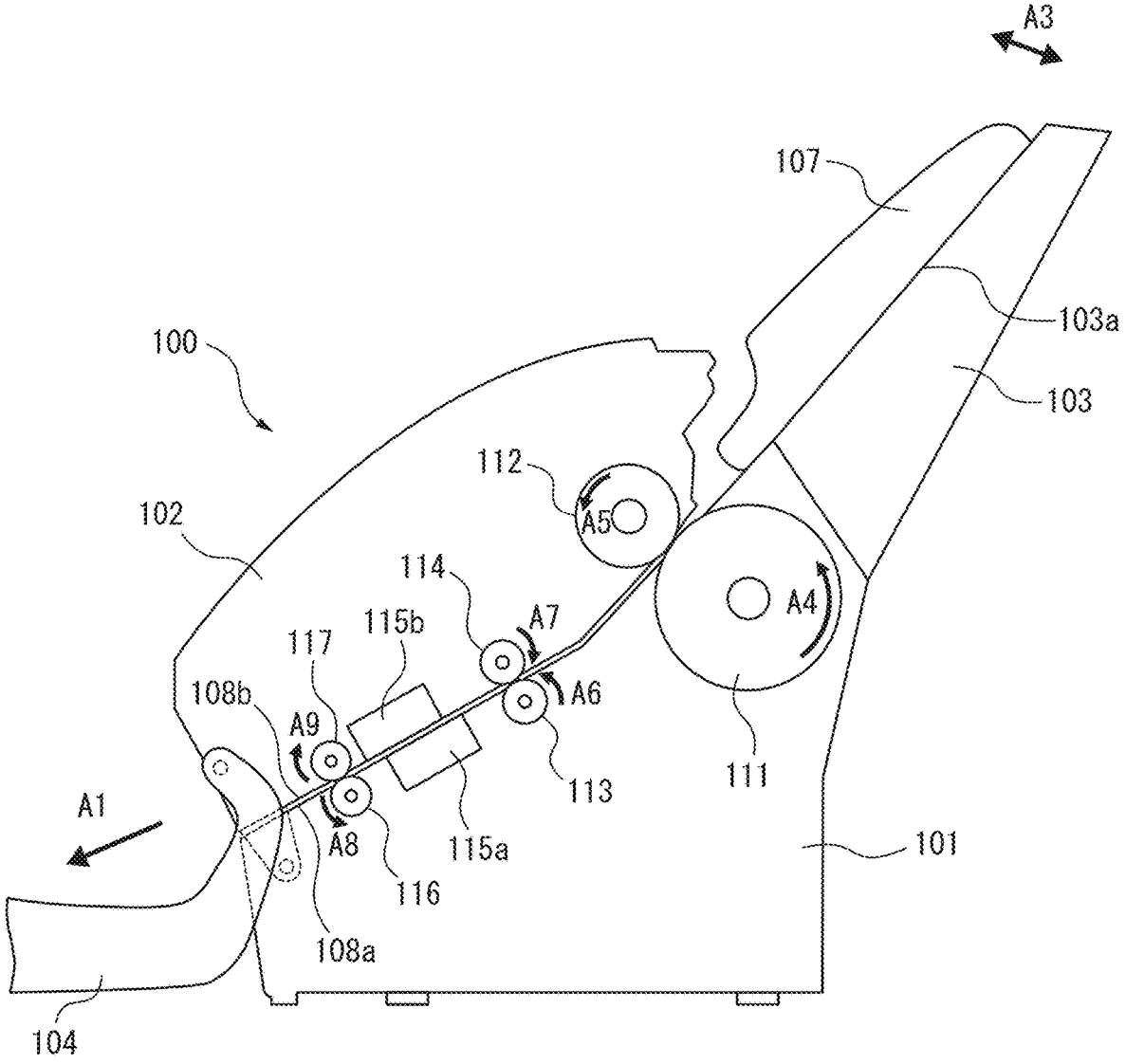
FIG. 2 is a diagram for illustrating a conveyance path inside the medium conveying apparatus 100.

FIG. 2 is a diagram for illustrating a conveyance path inside the medium conveying apparatus 100.

The conveyance path inside the medium conveying apparatus 100 includes a feed roller 111, a brake roller 112, a first conveyance roller 113, a second conveyance roller 114, a first imaging device 115*a*, a second imaging device 115*b*, a third conveyance roller 116 and a fourth conveyance roller 117, etc. The numbers of each roller is not limited to one, and may be plural.

A top surface of the lower housing 101 forms a lower guide 108*a* of a medium conveyance path. On the other hand, a bottom surface of the upper housing 102 faces the lower guide 108*a* and forms an upper guide 108*b* of the medium conveyance path. That is, the lower housing 101 and the upper housing 102 has a conveyance path capable of conveying the medium placed on the medium tray 103.

The feed rollers 111 are provided on the lower housing 101 and sequentially feed media placed on the medium tray 103 from the lower side. The brake roller 112 is provided in the upper housing 102 and is located to face the feed roller 111.

The first imaging device 115*a* is an example of an imaging unit, and is provided on the lower guide 108*a*, that is, on the conveyance path of the lower housing 101. The first imaging device 115*a* includes a line sensor based on a unity-magnification optical system type contact image sensor (CIS) including an imaging element based on a complementary metal oxide semiconductor (CMOS) linearly located in a main scanning direction. Further, the first imaging device 115*a* includes a lens for forming an image on the imaging element, and an A/D converter for amplifying and analog-digital (A/D) converting an electric signal output from the imaging element. The first imaging device 115*a* generates and outputs an input image imaging a front surface of a conveyed medium, in accordance with control from a processing circuit (not shown).

Similarly, the second imaging device 115*b* is an example of an imaging unit, and is provided on the upper guide 108*b*, that is, on the conveyance path of the upper housing 102. The second imaging device 115*b* includes a line sensor based on a unity-magnification optical system type CIS including an imaging element based on a CMOS linearly located in a main scanning direction. Further, the second imaging device 115*b* includes a lens for forming an image on the imaging element, and an A/D converter for amplifying and A/D converting an electric signal output from the imaging element. The second imaging device 115*b* generates and outputs an input image imaging a back surface of a conveyed medium, in accordance with control from the processing circuit.

Only either of the first imaging device 115*a* and the second imaging device 115*b* may be located in the medium conveying apparatus 100 and only one surface of a medium may be read. Further, a line sensor based on a unity-magnification optical system type CIS including an imaging element based on charge coupled devices (CCDs) may be used in place of the line sensor based on a unity-magnification optical system type CIS including an imaging element based on a CMOS. Further, a line sensor based on a reduction optical system type line sensor including an imaging element based on CMOS or CCDs.

A medium placed on the medium tray 103 is conveyed between the lower guide 108*a* and the upper guide 108*b* in the medium conveying direction A1 by the feed roller 111 rotating in a direction of an arrow A2 in FIG. 2, that is, a medium feeding direction. When a medium is conveyed, the brake roller 112 rotates in a direction of an arrow A5, that is, a direction opposite to the medium feeding direction. By the workings of the feed roller 111 and the brake roller 112, when a plurality of media are placed on the medium tray 103, only a medium in contact with the feed roller 111, out of the media placed on the medium tray 103, is separated. Consequently, the medium conveying apparatus 100 operates in such a way that conveyance of a medium other than the separated medium is restricted (prevention of multi-feed).

The medium is fed between the first conveyance roller 113 and the second conveyance roller 114 while being guided by the lower guide 108*a* and the upper guide 108*b*. The medium is fed between the first imaging device 115*a* and the second imaging device 115*b* by the first conveyance roller 113 and the second conveyance roller 114 rotating in directions of an arrow A6 and an arrow A7, respectively. The medium read by the first imaging device 115*a* and the second imaging device 115*b* is ejected on the ejection tray 104 by rotating the third conveyance roller 118 and the fourth conveyance roller 119 in directions of an arrow A6 and an arrow A7, respectively.

Figure 3:
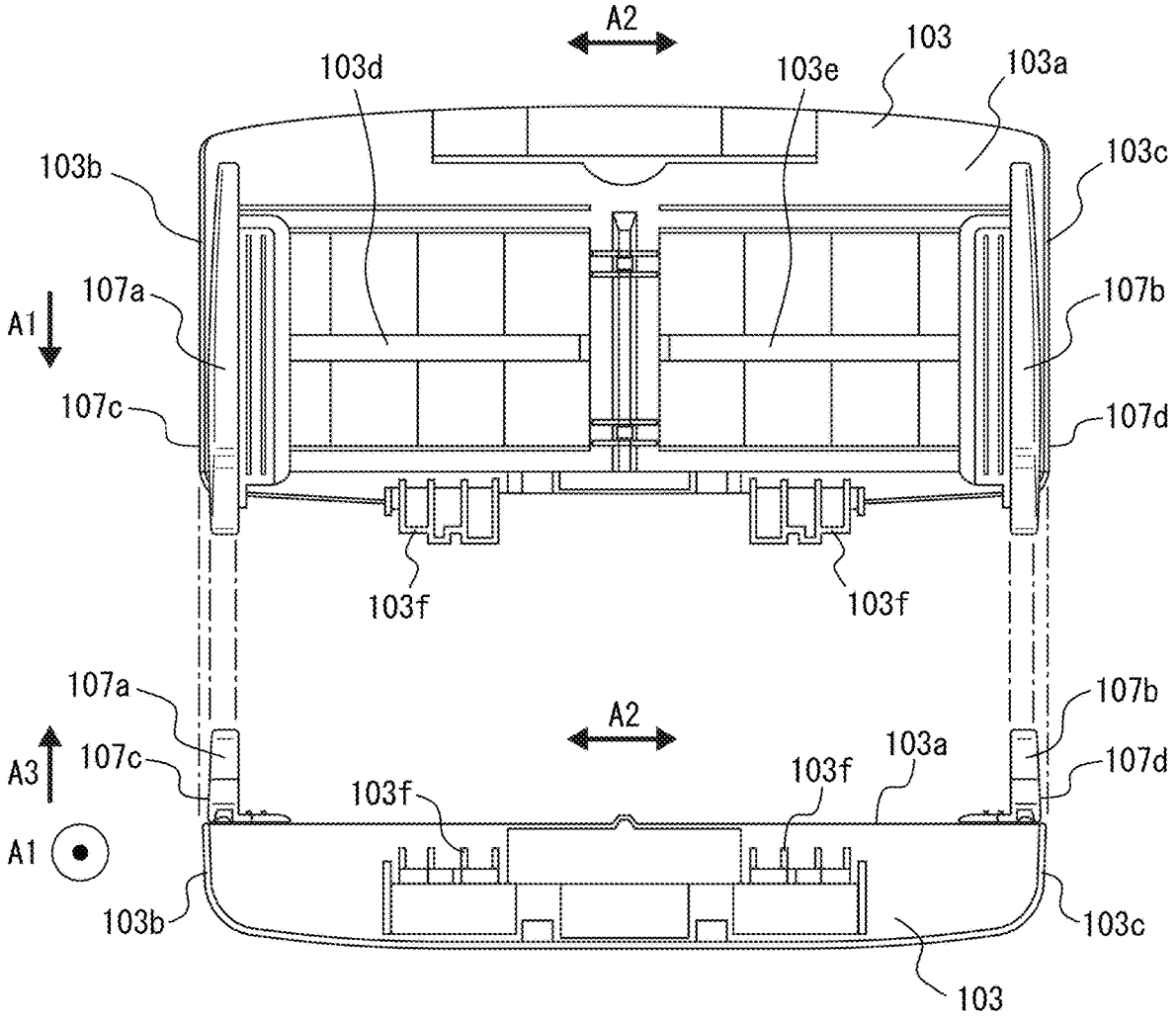
FIG. 3 is a schematic view for illustrating a side guide 107.
Figure 4:
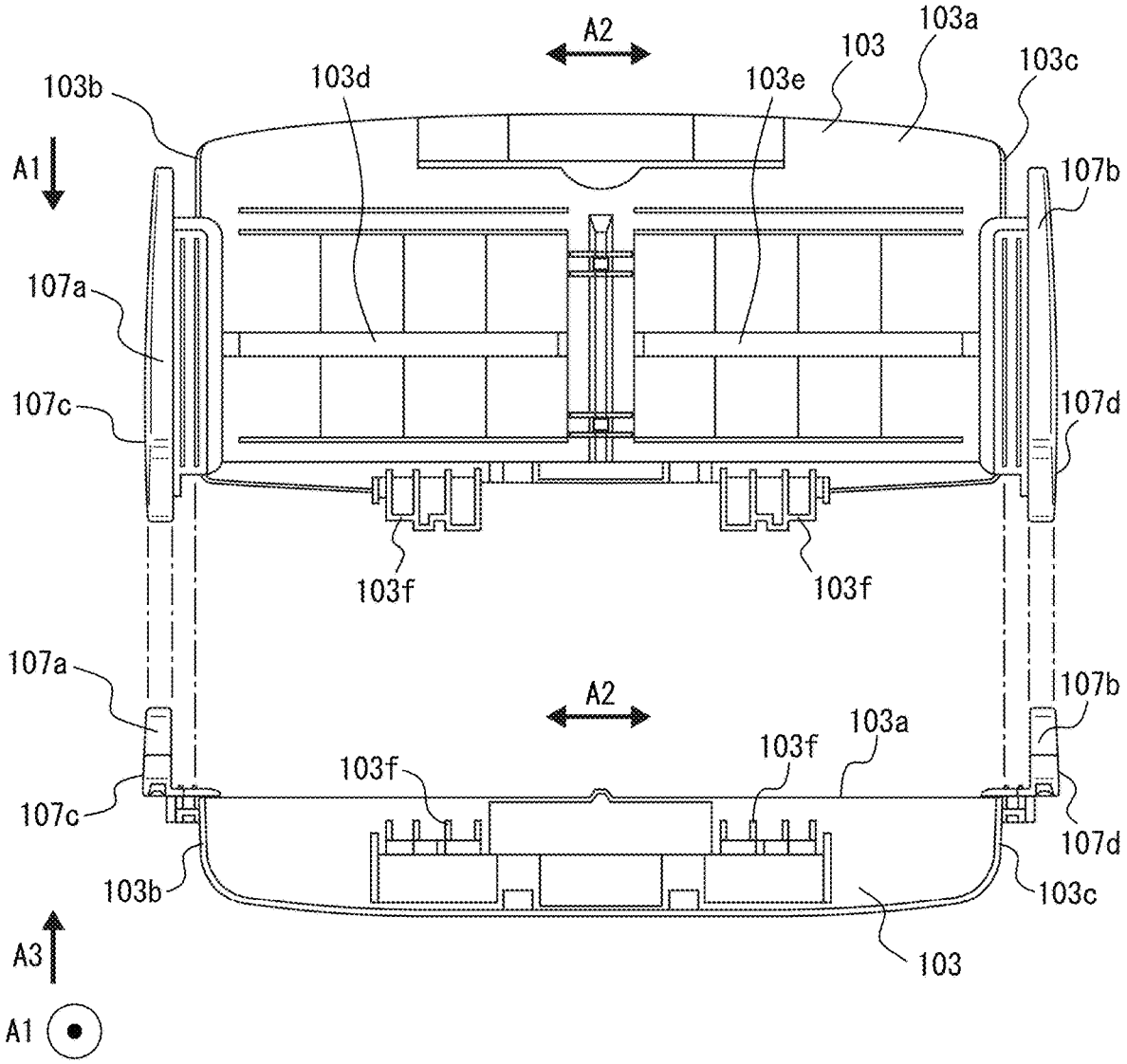
FIG. 4 is a schematic view for illustrating the side guide 107.

FIGS. 3 and 4 are schematic diagrams for illustrating the side guides 107. In FIGS. 3 and 4, the upper view is a plan view of the medium tray 103 removed from the lower housing 101 from above, the lower view is a side view of the medium tray 103 removed from the lower housing 101 from the downstream side, FIG. 3 shows a state that each of outer ends 107*c*, 107*d* of the side guides 107 is located on a position of each of outer ends 103*b*, 103*c* of the medium tray 103, in the width direction A2. FIG. 4 shows a state that each of outer ends 107*c*, 107*d* of the side guides 107 is located outside each of outer ends 103*b*, 103*c* of the medium tray 103, in the width direction A2.

As shown in FIG. 3 and FIG. 4, a first guide portion 103*d* and a second guide portion 103*e* are formed on the placing surface 103*a* of the medium tray 103. The first guide portion 103*d* and the second guide portion 103*e* are rails formed so as to extend in the width direction A2. On the other hand, a first engaging portion and a second engaging portion are formed on the lower surface side (the medium tray 103 side) of each of side guides 107. Each of the side guides 107 slides in the width direction A2 on the medium tray 103 by engaging each of the first engaging part and the second engaging part with each of the first guide portion 103*d* and the second guide portion 103*e* and moving each of the first engaging part and the second engaging part along each of the first guide portion 103*d* and the second guide portion 103*e*. As shown in FIG. 4, the side guides 107 are provided so as to be movable to an outside of the medium tray 103 in the width direction A2.

Further, the medium tray 103 is detachably provided with respect to the lower housing 101. The medium tray 103 is provided with a protrusion 103*f*, and the medium tray 103 is attached to the lower housing 101 by engaging the protrusion 103*f* with a recess provided in the lower housing 101. On the other hand, by removing the protrusion 103*f* from the recess, the medium tray 103 is removed from the lower housing 101.

Figure 5:
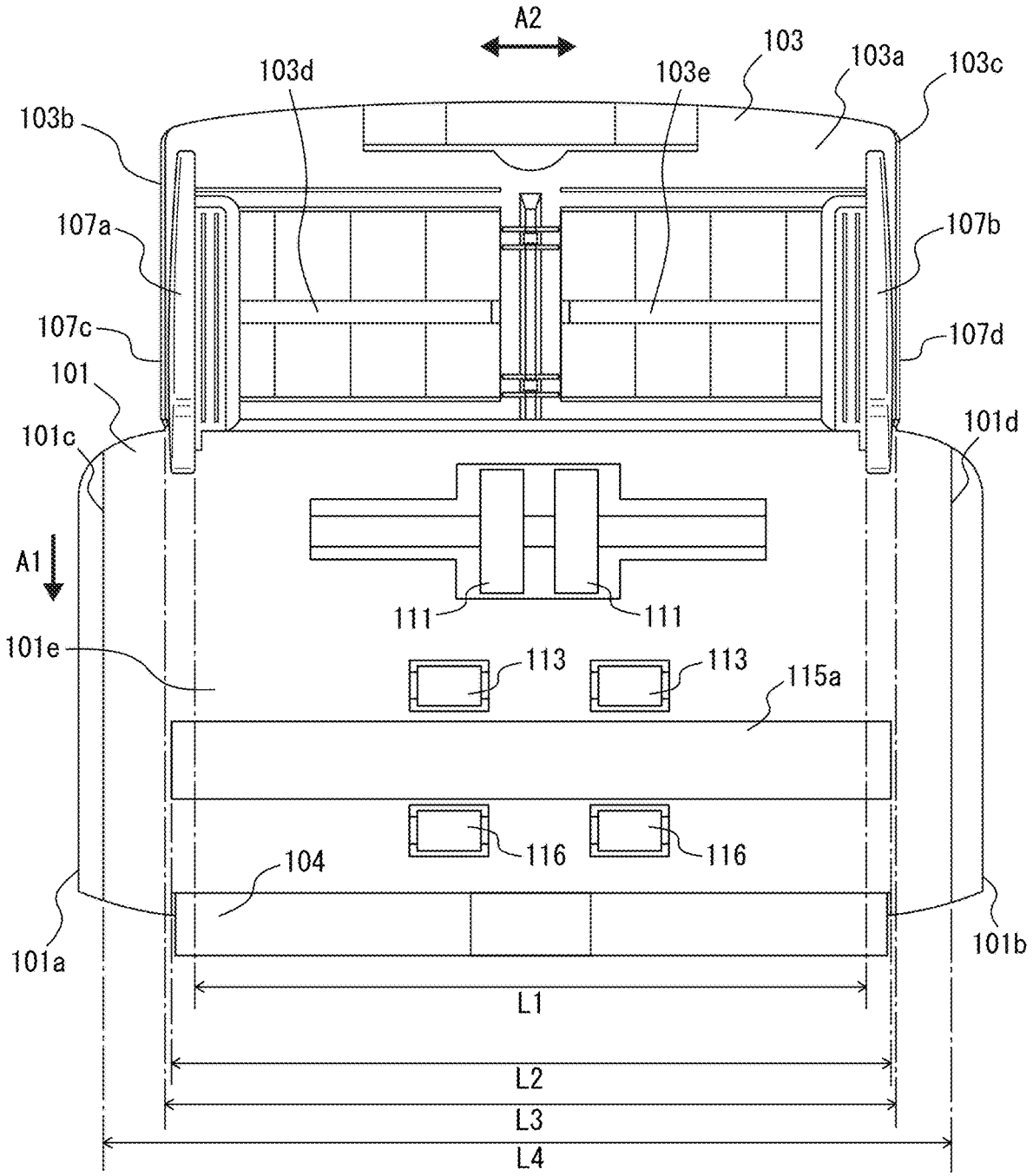
FIG. 5 is a schematic view for illustrating the side guide 107.
Figure 6:
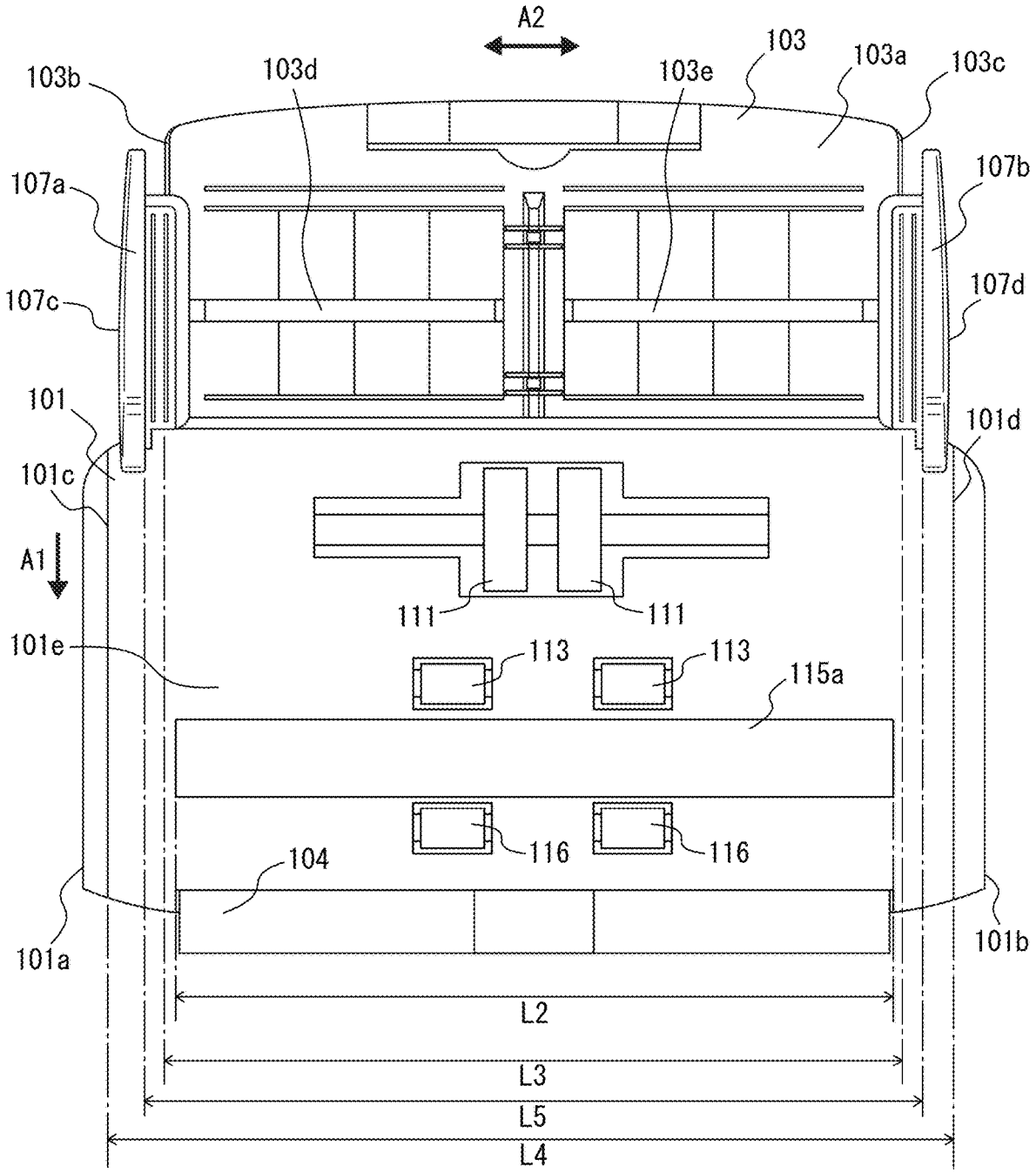
FIG. 6 is a schematic view for illustrating the side guide 107.

FIGS. 5 and 6 are schematic diagrams for illustrating the side guides 107. FIGS. 5 and 6 are schematic views of the medium conveying apparatus 100 from above in a state that the upper housing 102 is removed. FIG. 5, shows a state that each of the outer ends 107*c*, 107*d* of the side guide 107*s* is located on a position of each of the outer ends 103*b*, 103*d* of the medium tray 103, in the width direction A2. FIG. 5, shows a state that each of the outer ends 107*c*, 107*d* of the side guide 107*s* is located outside each of the outer ends 103*b*, 103*d* of the medium tray 103, in the width direction A2.

As shown in FIGS. 5 and 6, a width (a distance between the outer end portions 103*b*, 103*c*) of the medium tray 103 is smaller than a width (a distance between the outer end portions 101*a*, 101*b*) of the lower housing 101, in the width direction A2. Thus, the medium conveying apparatus 100 can reduce a size of the medium tray 103 with respect to the lower housing 101, thereby, compact the appearance of the entire medium conveying apparatus 100.

As shown in FIG. 5, a width L1 of an inside of the side guides 107 when each of the outer ends 107*c*, 107*d* is located on the position of each of the outer ends 103*b*, 103*c* of the medium tray 103, in the width direction A2, is set, for example, the maximum standard size supported by the medium conveying apparatus 100. The maximum standard size supported by the medium conveying apparatus 100 is a legal-size (215.9 mm) or A4 vertical size (210 mm), etc. Hereinafter, the width L1 of the inside of the side guides 107 when each of the outer ends 107*c*, 107*d* is located on the position of each of the outer ends 103*b*, 103*c* of the medium tray 103, in the width direction A2 may be referred to as a reference width.

In the width direction A2, an imaging range L2 of the imaging device 115 is larger than the reference width L1. Thus, even when the medium having the reference width is conveyed inclined, the imaging device 115 can image the entire conveyed medium.

Further, in the width direction A2, a maximum width L3 (a distance between the outer ends 103*b* and 103*c*) of the medium tray 103 is larger than the imaging range L2 of the imaging device 115. In the width direction A2, the maximum width L3 of the medium tray 103 may be smaller than the imaging range L2 of the imaging device 115. In this case, the medium conveying apparatus 100 can reduce the size of the medium tray 103 and compact the appearance of the entire medium conveying apparatus 100.

Further, in the width direction A2, a width L4 (a distance between side walls 101*c* and 101*d*) of the conveyance path 101*e* is larger than the imaging range L2 of the imaging device 115. In other words, the imaging range of the imaging device 115 is separated from both ends of the conveyance path in the width direction A2 perpendicular to the medium conveying direction by a predetermined distance or more. For example, a distance between each of the side walls 101*c*, 101*d* of the conveyance path 101*e* and each of ends of the imaging range of the imaging device 115 in the width direction A2 is set to be larger than a general size of an area where the sprocket hole is provided. Thus, the medium conveying apparatus 100 can suitably convey a general paper in which the sprocket hole is provided, and the imaging device 115 can reliably image the entire area in which information is described in the paper when such paper is conveyed.

In the width direction A2, the width L4 of the conveyance path 101*e* is larger than the maximum width L3 of the medium tray 103. Thus, the medium conveying apparatus 100 can reduce the size of the medium tray 103 and compact the appearance of the entire medium conveying apparatus 100 while preventing the media from colliding with the side walls 101*c*, 101*d* and suppressing an occurrence of a jam of the medium, even when the media is tilted and conveyed.

Further, as shown in FIG. 6, the width L5 of the inside of the side guides 107 in the width direction A2 when each of the outer ends 107*c*, 107*d* is located outside each of the outer ends 103*b*, 103*c* of the medium tray 103, is larger than the imaging range L2 of the imaging device 115. For example, a distance between the inside of the side guides 107 in the outermost position and each of the end of the imaging range of the imaging device 115 in the width direction A2 is set to be larger than the general size of the region where the sprocket hole is provided in the paper. Thus, the medium conveying apparatus 100 can suitably convey the general paper in which the sprocket hole is provided, and the imaging device 115 can reliably image the entire area in which the information is described in the paper when such paper is conveyed.

Further, the width L5 of the inside of the side guides 107 in the width direction A2 when each of the outer ends 107*c*, 107*d* is located outside each of the outer ends 103*b*, 103*c* of the medium tray 103 is larger than the maximum width L3 of the medium tray 103. Thus, the medium conveying apparatus 100 can suitably convey a medium having a width larger than the reference width, while reducing the size of the medium tray 103, to compact the appearance of the entire medium conveying apparatus 100.

Further, in the width direction A2, the width L4 of the conveyance path 101*e* is larger than the width L5 of the inside of the side guides 107 when each of the outer ends 107*c*, 107*d* is located outside each of the outer ends 103*b*, 103*c* of the medium tray 103. In other words, the conveyance path 101*e* can convey a medium having a width of the inside of the side guides 107 even when the outer ends 107*c*, 107*d* of the side guides 107 is positioned outside the maximum width of the medium tray 103. Thus, the medium conveying apparatus 100 can prevent the media from colliding with the side walls 101*c*, 101*d* and suppress an occurrence of a jam of the medium, even when the media having a width larger than the reference width is conveyed at tilted.

In other words, the side guides 107 are located on the medium tray 103 so that the outer ends 107*c*, 107*d* of the side guides 107 can be positioned from an inside of the medium tray 103 to an outside of the maximum width of the medium tray 103. Thus, the medium conveying apparatus 100 can suitably convey a medium having a width larger than the reference width, while reducing the size of the medium tray 103, to compact the appearance of the entire medium conveying apparatus 100. Further, the side guides 107 are provided so that the outer ends 107*c*, 107*d* of the side guides 107 can move from the inside of the medium tray 103 to the outside of the maximum width of the medium tray 103 in the width direction A2 perpendicular to the medium conveying direction. Thus, the medium conveying apparatus 100 can suitably convey, for a plurality of media having a width larger than the reference width and having a width different from each other, each medium while regulating the width direction of each medium to match the size of each medium.

The width L5 of the inside of the side guides 107 when each of the outer ends 107*c*, 107*d* is located outside each of the outer ends 103*b*, 103*c* of the medium tray 103 may be smaller than the imaging range L2 of the imaging device 115, the maximum width L3 of the medium tray 103 or the width L4 of the conveyance path 101*e*. Also, the imaging range of the imaging device 115 may be in contact with the side walls 101*c*, 101*d* of the conveyance path.

Figure 7A:
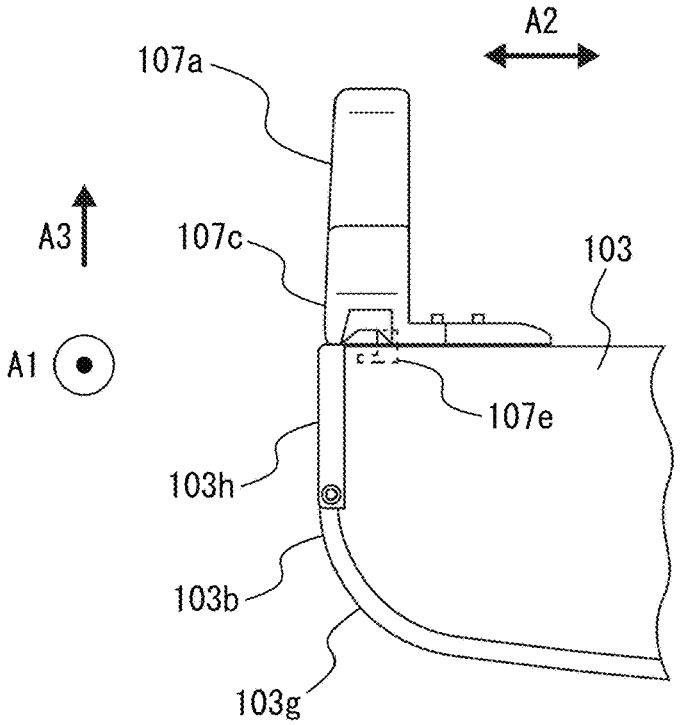
FIG. 7A is a schematic diagram for illustrating covers 103*g* of a medium tray 103.
Figure 7B:
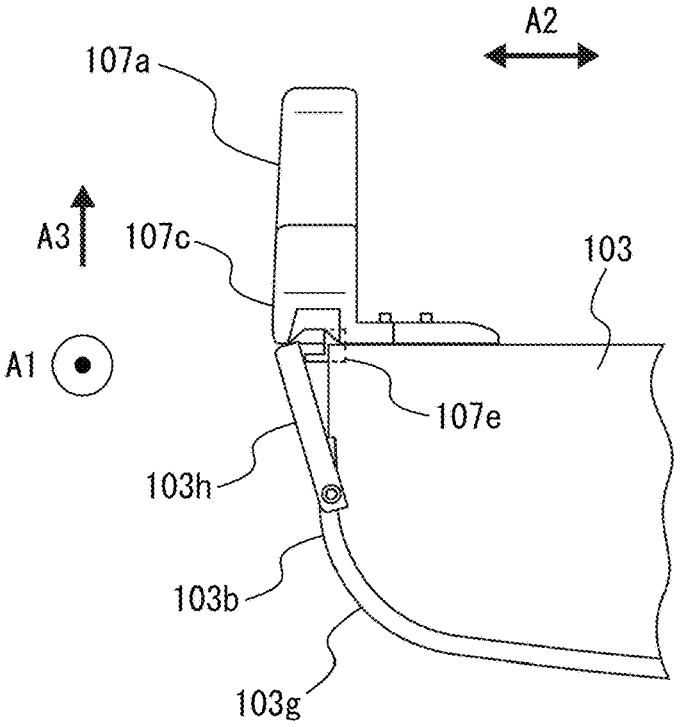
FIG. 7B is a schematic diagram for illustrating covers 103*g* of the medium tray 103.

FIGS. 7A and 7B are schematic diagrams for illustrating a cover 103*g* of the medium tray 103. FIGS. 7A and 7B is a part of a side view of the medium tray 103 removed from the lower housing 101 from the downstream side. FIG. 7A shows a state in which the outer end 107*c* of the first side guide 107*a* is located at the position of the outer end 103*b* of the medium tray 103 in the width direction A2. FIG. 7B shows a state in which the outer end 107*c* of the first side guide 107*a* is located outside the outer end 103*b* of the medium tray 103 in the width direction A2. Although only one side (the first side guide 107*a* side) of the medium tray 103 in the width direction A2 will be described below, a similar configuration is provided on the other side (second side guide 107*b* side) of the medium tray 103.

As shown in FIGS. 7A and 7B, the medium tray 103 has the cover 103*g*. At the end of the cover 103*g* in the width direction A2, a support member 103*h* is swingably provided outward. A pressing force directed inward in the width direction A2 is applied to the swinging shaft of the support member 103*h* by a coil spring or the like. As shown in FIG. 7A, the support member 103*h* supports the first side guides 107*a* located at the position of the outer end 103*b* of the maximum width of the medium tray 103. On the other hand, a protrusion 107*e* to move with a movement of the side guide 107 is provided on the lower surface of the side guide 107. As shown FIG. 7B, when the outer end 107*c* of the side guide 107 is located outside the outer end 103*b* of the medium tray 103, the protrusion 107*e* abuts the support member 103*h* to push the support member 103*h* outward. The support member 103*h* also supports the first side guide 107*a* when the support member 103*h* is extruded outward by the protrusion 107*e*.

In this manner, the cover 103*g* moves in conjunction with a movement of the side guide 107 to the outside of the maximum width of the medium tray 103, and supports the side guide 107 positioned at an outside of an outer end of the maximum width of the medium tray 103. Accordingly, the medium conveying apparatus 100 stably supports the side guide 107 with sufficient force even when the side guide 107 is located outside the medium tray 103. Thus, the medium conveying apparatus 100 ensures an intensity of the side guide 107. The medium conveying apparatus 100 can suppress that the side guide 107 is deformed or damaged, such as when the user accidentally touches the side guide 107 or when the user drops the medium tray 103. The cover 103*g* may be provided so as to be fixed.

As described in detail above, in the medium conveying apparatus 100, the side guide 107 is located on outside the medium tray 103. Thus, the medium conveying apparatus 100 can appropriately convey a medium having a width larger than the reference width. Therefore, the medium conveying apparatus 100 can suitably convey media of various sizes, while suppressing an increase in a size of the medium tray 103.

In particular, the medium conveying apparatus 100 can convey a medium having a width equal to or less than the reference width by locating the side guide 107 inside the medium tray 103, and convey a medium having a width larger than the reference width by locating the side guide 107 outside the medium tray 103. In the medium conveying apparatus 100, a medium having a width equal to or less than the maximum standard size supported by the medium conveying apparatus 100 is conveyed in most utilization scenes, and medium having a width larger than the maximum standard size is conveyed very rarely. In most utilization scenes, the user can smoothly set the side guide 107 since the side guide 107 is moved only on the placing surface 103*a* of the medium tray 103. On the other hand, even in a rare case of conveying medium having a special size, the user can suitably convey such a medium by moving the side guide 107 to the outside of the medium tray 103.

Further, the medium conveying apparatus 100 can compact the appearance of the entire medium conveying apparatus 100, to reduce an apparatus exclusive area when the apparatus is used (installation area), the apparatus weight and apparatus cost, by reducing the size of the medium tray 103.

Figure 8A:
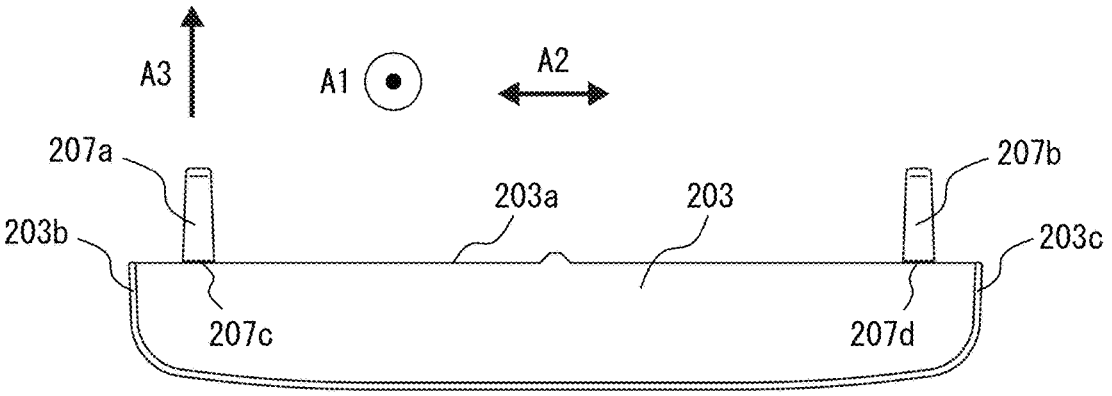
FIG. 8A is a schematic view for illustrating other side guides 207, etc.
Figure 8B:
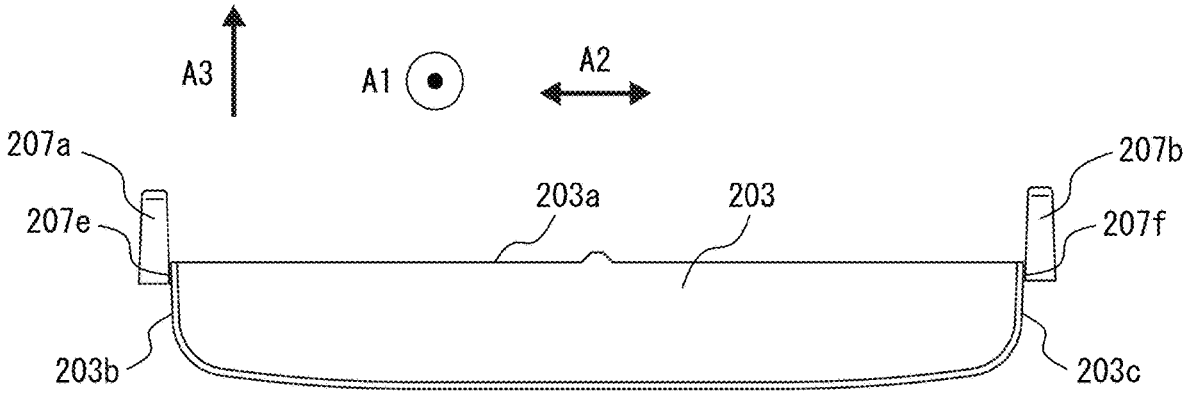
FIG. 8B is a schematic view for illustrating the other side guides 207, etc.

FIGS. 8A and 8B are schematic views illustrating a medium tray 203 and a first side guide 207*a*, a second side guide 207*b* in a medium conveying apparatus according to another embodiment. FIGS. 8A and 8B are side views of the medium tray 203 removed from the lower housing 101 from the downstream side. Hereinafter, the first side guide 207*a* and the second side guide 207*b* may be collectively referred to as side guides 207. The medium tray 203 and the side guides 207 are used in place of the medium tray 103 and the side guides 107 of the medium conveying apparatus 100, respectively.

The side guides 207 are detachably provided with respect to the medium tray 203. One set of an upper surface (a placing surface 203*a*) and side surfaces 203*b*, 203*c* of the medium tray 203 or lower surfaces 207*c*, 207*d* and side surfaces 207*e*, 207*f* of the first side guide 207*a* and the second side guide 207*b* is formed with a permanent magnet, and the other set is formed with a ferromagnet. A permanent magnet is, for example, an alnico magnet, a ferrite magnet, a neodymium magnet, etc. A ferromagnet is, for example, iron, cobalt, nickel, gadolinium, etc. The medium tray 203 and the side guides 207 may be configured in any way if they attract to each other. For example, both the set of the placing surface 203*a* and the side surfaces 203*b*, 203*c* of the medium tray 203, and the set of the lower surfaces 207*c*, 207*d* and the side surfaces 207*e*, 207*f* of the side guides 207 may be formed with a permanent magnet.

As shown in FIG. 8A, the side guides 207 are located at an arbitrary position on the placing surface 203*a* of the medium tray 203 by locating the lower surfaces 207*c*, 207*d* on the arbitrary position of the placing surface 203*a* of the medium tray 203. Also, the side guide 207 are located outside the mount 203 by attaching the side surfaces 207*e*, 207*f* on the side surfaces 203*b*, 203*c* of the medium tray 203. Thus, the side guides 207 are located on the medium tray 203 so that outer ends can be positioned from an inside of the medium tray 203 to an outside of the maximum width of the medium tray 203.

Figure 9A:
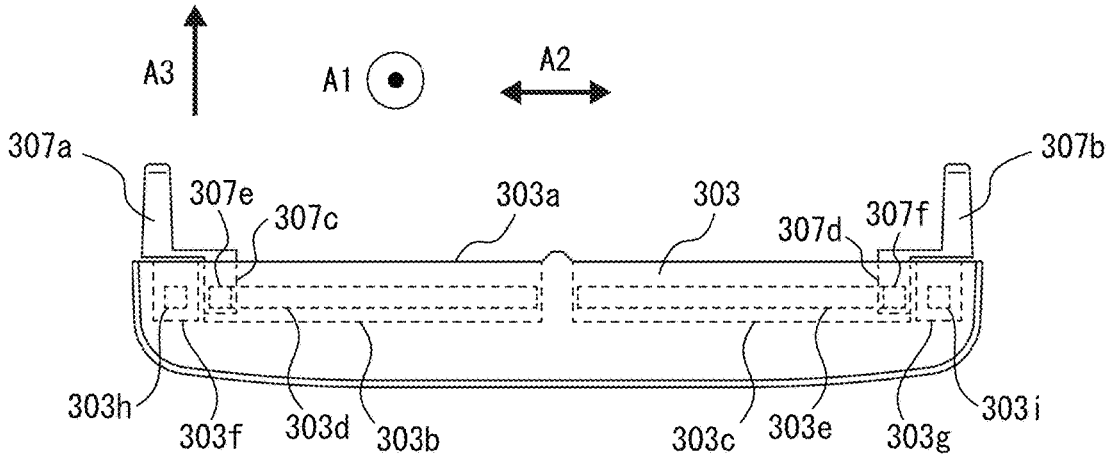
FIG. 9A is a schematic view for illustrating other side guides 307, etc.
Figure 9B:
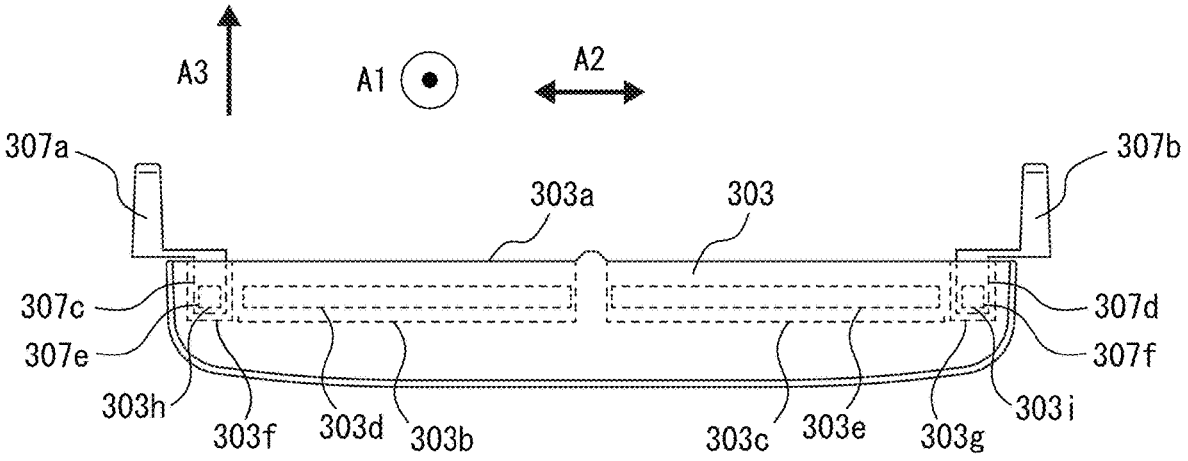
FIG. 9B is a schematic view for illustrating the other side guides 307, etc.

FIGS. 9A and 9B are schematic views illustrating a medium tray 303 and a first side guide 307*a*, and second side guide 307*b* in a medium conveying apparatus according to still another embodiment. FIGS. 9A and 9B are views of the medium tray 303 removed from the lower housing 101 from the downstream side. Hereinafter, the first side guide 307*a* and the second side guide 307*b* may be collectively referred to as side guides 307. The medium tray 303 and the side guides 307 are used in place of the medium tray 103 and the side guides 107 of the medium conveying apparatus 100, respectively.

The side guides 307 are detachably provided with respect to the medium tray 303. A first guide portion 303*b* and a second guide portion 303*c* are formed on the placing surface 303*a* of the medium tray 303. The first guide portion 303*b* and the second guide portion 303*c* are rails formed so as to extend in the width direction A2. A first recess 303*d* and second recess 303*e* are formed at upstream and downstream ends of the first guide portion 303*b* and the second guide portion 303*c*. Further, a first engaged portion 303*f* and a second engaged portion 303*g* are formed at both ends in the width direction A2 of the placing surface 303*a* of the medium tray 303. A third recess 303*h*, fourth recess 303*i* are formed at upstream and downstream ends of the first engaged portion 303*f* and the second engaged portion 303*g*. On the other hand, a first engaging part 307*c* and a second engaging part 307*d* are formed on the side guides 307. A first protrusion 307*e* and a second protrusion 307*f* are formed at upstream and downstream ends of the first engaging part 307*c* and a second engaging part 307*d*.

As shown in FIG. 9A, the side guides 307 are attached to the medium tray 303 by engaging the first protrusion 307*e* and the second protrusion 307*f* to the first recess 303*d* and the second recess 303*e*. Further, the side guides 307 slides in the width direction A2 on the medium tray 303, by moving the first engaging part 307*c* and a second engaging part 307*d* along the first guide portion 303*b* and the second guide portion 303*c*. Further, the side guides 307 are removed from the medium tray 303 by removing the first protrusion 307*e* and the second protrusion 307*f* from the first recess 303*d* and the second recess 303*e*.

On the other hand, as shown in FIG. 9B, the side guides 307 are engaged with the first engaging part 303*f* and the second engaging part 303*g* and located outside the medium tray 303, by engaging the first protrusion 307*e* and the second protrusion 307*f* with the third recess 303*h* and the fourth recess 303*i*. Thus, the side guides 307 are located on the medium tray 303 so that the outer ends can be positioned from an inside of the medium tray 303 to an outside of the maximum width of the medium tray 303.

Figure 10A:
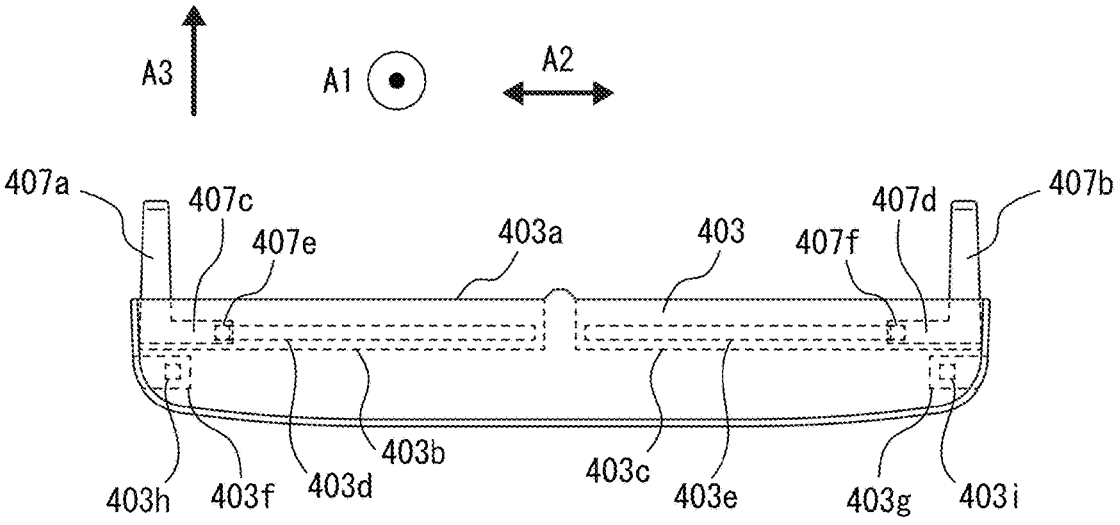
FIG. 10A is a schematic view for illustrating other side guides 407, etc.
Figure 10B:
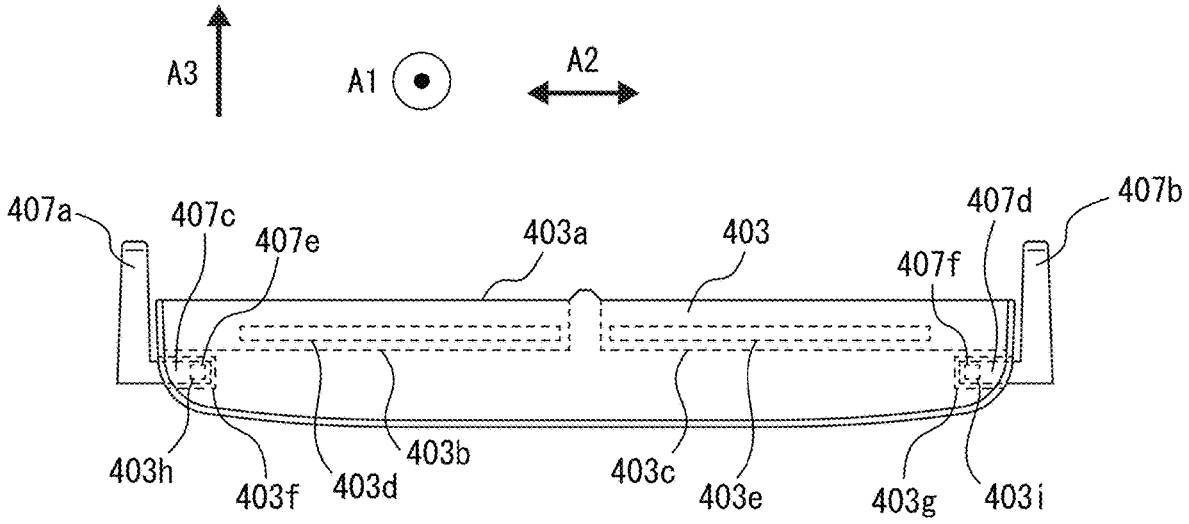
FIG. 10B is a schematic view for illustrating the other side guides 407, etc.

FIGS. 10A and 10B are schematic views illustrating a medium tray 403 and a first side guide 407*a* and a second side guide 407*b* in a medium conveying apparatus according to another embodiment. FIGS. 10A and 10B are side views of the medium tray 403 removed from the lower housing 101 from the downstream side. Hereinafter, the first side guide 407*a* and the second side guide 407*b* may be collectively referred to as side guides 407. The medium tray 403 and the side guides 407 are used in place of the medium tray 103 and the side guides 107 of the medium conveying apparatus 100, respectively.

A first guide portion 403*b*, a second guide portion 403*c*, a first recess 403*d*, and a second recess 403*e* are formed on a placing surface 403*a* of the medium tray 403. A first engaged portion 403*f*, a second engaged portion 403*g*, a third recess 403*h* and a fourth recess 403*i* are formed on a side surface of the medium tray 403. On the other hand, a first engaging portion 407*c*, a second engaging portion 407*d*, a first protrusion 407*e* and a second protrusion 407*f* are formed in the side guides 407. The function of each portion of the medium tray 403 and the side guides 407 is similar to the function of each portion of the medium tray 303 and the side guides 307. However, as shown in FIG. 10B, the side guides 407 are engaged in the first engaging portion 403*f* and the second engaging portion 403*g* and located outside the mount 303, by engaging the first protrusion 407*e* and the second protrusion 407*f* with the third recess 403*h* and the fourth recess 403*i*. Thus, the side guides 407 are located on the medium tray 403 so that the outer ends can be positioned from an inside of the medium tray 403 to an outside of the maximum width of the medium tray 403.

As described in detail above, the medium conveying apparatus, can suitably convey media of various sizes, while suppressing an increase in the size of the medium tray, even when the side guides are detachably provided from the medium tray.

Figure 11A:
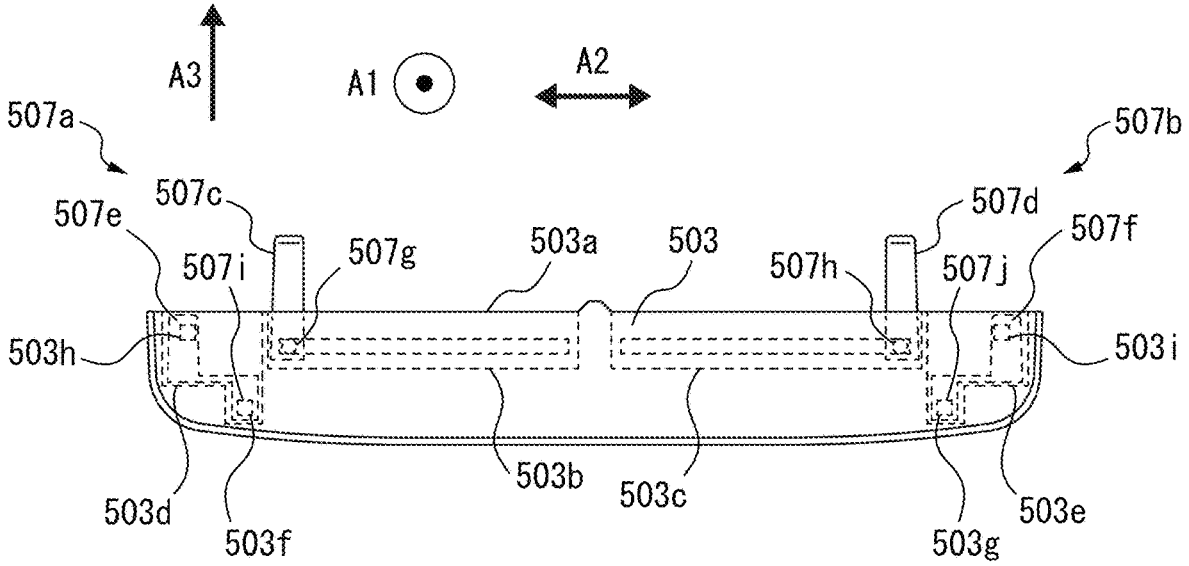
FIG. 11A is a schematic view for illustrating other side guides 507, etc.
Figure 11B:
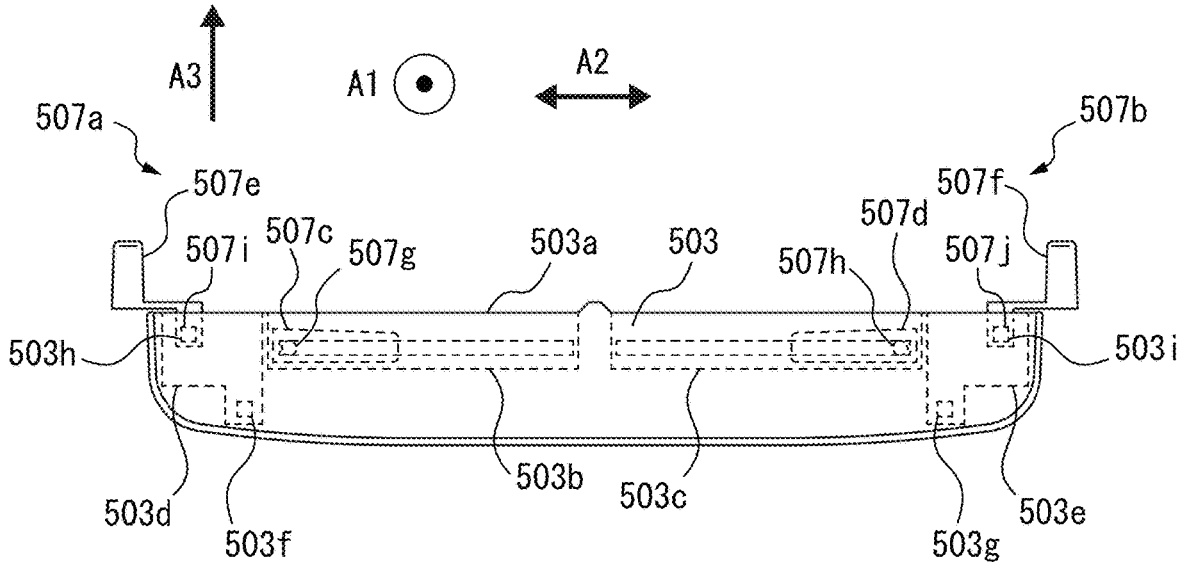
FIG. 11B is a schematic view for illustrating the other side guides 507, etc.

FIGS. 11A and 11B are schematic views illustrating the medium tray 503, the first side guide 507 and the second side guide 507*b* in a medium conveying apparatus according to another embodiment. FIGS. 11A and 11B are side views of the medium tray 503 removed from the lower housing 101 from the downstream side. Hereinafter, the first side guide 507*a* and the second side guide 507*b* may be collectively referred to as side guides 507. The medium tray 503 and the side guide 507 are used in place of the medium tray 103 and the side guides 107 of the medium conveying apparatus 100, respectively.

A first guide part 503*b* and a second guide part 503*c* are formed on a placing surface 503*a* of the medium tray 503. The first guide part 503*b* and the second guide part 503*c* are rails formed so as to extend in the width direction A2. Further, a first accommodation portion 503*d* and a second accommodation portion 503*e* are formed at both ends in the width direction A2 of the placing surface 503*a* of the medium tray 503. A first lower recess 503*f* and a second lower recess 503*g* are formed below upstream and downstream ends of the first accommodation portion 503*d* and the second accommodation portion 503*e*. A first upper recess 503*h* and a second upper recess 503*i* are formed above upstream and downstream ends of the first accommodation portion 503*d* and the second accommodation portion 503*e*. On the other hand, the side guides 507 include a first inner side guide 507*c*, a second inner side guide 507*d*, a first outer side guide 507*e* and a second outer side guide 507*f*. A first engaging part 507*g* and a second engaging part 507*h* are formed in the first inner side guide 507*c* and the second inner side guide 507*d*. A first protrusion 507*i* and a second protrusion 507*j* are formed at upstream and downstream ends of the first outer side guide 507*e* and the second outer side guide 507*f*.

As shown in FIG. 11A, the first inner side guide 507*c* and the second inner side guide 507*d* slide on the medium tray 503 by moving the first engaging part 507*g* and the second engaging part 507*h* along the first guide part 503*b* and the second guide part 503*c*. In other words, the first, the first inner side guide 507*c* and the second inner side guide 507*d* are movably provided in the width direction A2 perpendicular to the medium conveying direction on the medium tray 503. On the other hand, the first outer side guide 507*e* and the second outer side guide 507*f* are accommodated in the first accommodation portion 503*d* and the second accommodation portion 503*e* by engaging the first protrusion 507*i* and the second protrusion 507*j* with the first lower recess 503*f* and the second lower recess 503*g*. Thus, the first, the first outer side guide 507*e* and the second outer side guide 507*f* are provided so that the first, the first outer side guide 507*e* and the second outer side guide 507*f* are accommodated in the medium tray 503.

Further, as shown in FIG. 11B, the first inner side guide 507*c* and the second inner side guide 507*d* are rotatably provided toward an inside of the width direction A2 about the first engaging portion 507*g* and the second engaging portion 50711. The first inner side guide 507*c* and the second inner side guide 507*d* are accommodated in the first guide portion 503*b* and the second guide portion 503*c*, by tilting toward an inside of the width direction A2 about the first engaging portion 507*g* and the second engaging portion 507*h*. Thus, the first, the first inner side guide 507*c* and the second inner side guide 507*d* are provided so that the first, the first outer side guide 507*e* and the second outer side guide 507*f* are accommodated in the medium tray 503. On the other hand, the first, the first outer side guide 507*e* and the second outer side guide 507*f* can be drawn out from the first accommodation portion 503*d* and a second accommodation portion 503*e*, by removing the first protrusion 507*i* and the second protrusion 507*j* from the first lower recess 503*f* and the second lower recess 503*g*. The first, the first outer side guide 507*e* and the second outer side guide 507*f* are located outside the medium tray 503, by engaging the first protrusion 507*i* and the second protrusion 507*j* with the first upper recess 503*i* and the second upper recess 503*i*. In other words, the first outer side guide 507*e* and the second outer side guide 507*f* are located outside the first inner side guide 507*c* and the second inner side guide 507*d* in the width direction A2 perpendicular to the medium conveying direction. Thus, the side guides 507 are located on the medium tray 503 so that the outer ends can be positioned from an inside of the medium tray 503 to an outside of the maximum width of the medium tray 503.

Figure 12A:
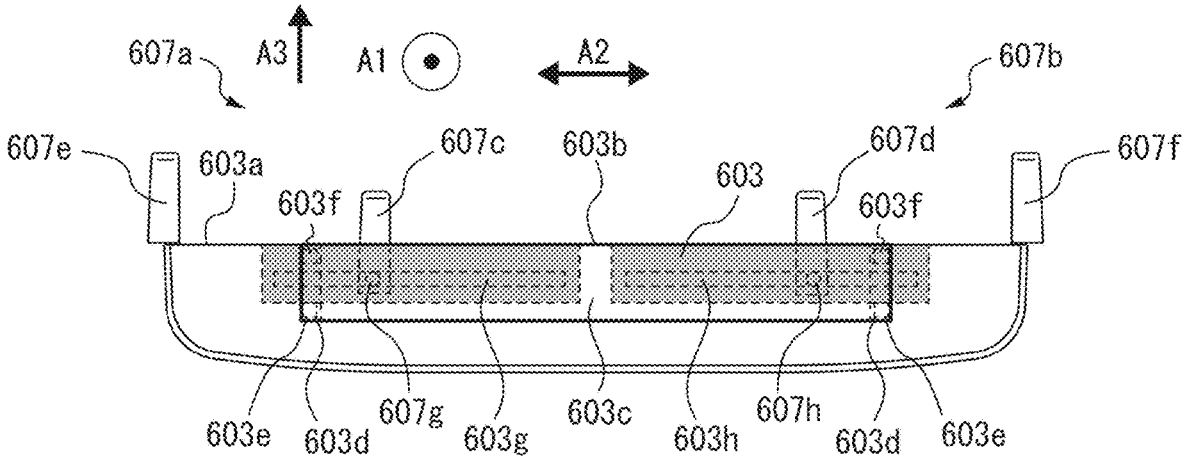
FIG. 12A is a schematic view for illustrating other side guides 607, etc.
Figure 12B:
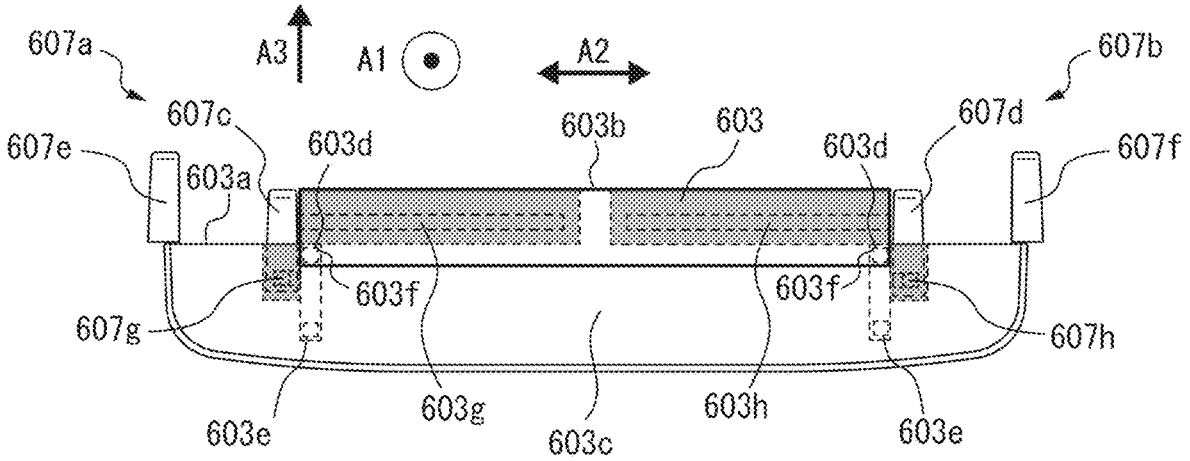
FIG. 12B is a schematic view for illustrating the other side guides 607, etc.

FIGS. 12A and 12B are schematic views illustrating the medium tray 603, the first side guide 607*a* and the second side guide 607*b* in a medium conveying apparatus according to another embodiment. FIGS. 12A and 12B are side views of the medium tray 603 removed from the lower housing 101 from the downstream side. Hereinafter, the first side guide 607*a* and the second side guide 607*b* may be collectively referred to as side guides 607. The medium tray 603 and the side guides 607 are, used in place of the medium tray 103 and the side guides 107 of the medium conveying apparatus 100, respectively.

The medium tray 603 includes a moving member 603*b* and an accommodation portion 603*c* provided at the center in the width direction A2. Protrusions 603*d* are formed at upstream and downstream ends of the moving member 603*b*. On the other hand, lower recesses 603*e* are formed below the upstream and downstream ends of the accommodation portion 603*c*, and lower recesses 603*e* are formed above the upstream and downstream ends of the accommodation portion 603*c*. A first guide portion 603*g* and a second guide portion 603*h* are formed on the placing surface 603*a* of the medium tray 603. The first guide portion 603*g* and the second guide portion 603*h* are rails formed so as to extend in the width direction A2, and are formed over the moving member 603*b* and portions other than the moving member 603*b*.

The side guides 607 include a first inner side guide 607*c*, a second inner side guide 607*d*, a first outer side guide 607*e* and a second outer side guide 607*f*. A first engaging part 607*g* and a second engaging part 607*h* are formed in the first inner side guide 607*c* and the second inner side guide 607*d*. In the height direction A3 perpendicular to the placing surface 603*a* of the medium tray 603, a height of the first outer side guide 607*e* and the second outer side guide 607*f* is larger than the height of the first inner side guide 607*c* and the second inner side guide 607*d*. One of the upper surface (the placing surface 603*a*) of the medium tray 603 or a lower surface of the first outer side guide 607*e* and the second outer side guide 607*f* is formed with a permanent magnet and the other is formed with a ferromagnetic. Both of the placing surface 603*a* of the medium tray 603 and the lower surface of the first outer side guide 607*e* and the second outer side guide 607*f* may be formed with a permanent magnet.

As shown in FIG. 12A, the first inner side guide 607*c* and the second inner side guide 607*d* slide on the medium tray 603, by moving the first engaging part 607*g* and the second engaging part 607*h* along the first guide portion 603*g* and the second guide portion 603*h*. In other words, the first inner side guide 607*c* and the second inner side guide 607*d* are movably provided in the width direction A2 perpendicular to the medium conveying direction on the medium tray 603. The moving member 603*b* is accommodated in the accommodation portion 603*c* by engaging the protrusions 603*d* with the lower recesses 603*e*.

Further, as shown in FIG. 12B, the moving member 603*b* is provided so that the moving member 603*b* is drawn upward from the accommodation portion 603*c* to a substantial same height as the first inner side guide 607*c* and the second inner side guide 607*d*. The moving member 603*b* is locked at a position shown in FIG. 12B, by the moving member 603*b* pulled out and the protrusions 603*d* engaged with the upper recesses 603*f*, in a state where the first inner side guide 607*c* and the second inner side guide 607*d* are located outside the moving member 603*b* in the width direction A2. Thus, the moving member 603*b* is movably provided upward, inside the first inner side guide 607*c* and the second inner side guide 607*d* in the width direction A2 perpendicular to the medium conveying direction. Since the upper surface of the moving member 603*b* drawn from the accommodation portion 603*c* and the upper surface of the first inner side guide 607*c* and the second inner side guide 607*d* are formed substantially flush with each other, a medium is suitably placed on the medium tray 603.

On the other hand, the first outer side guide 607*e* and the second outer side guide 607*f* are located on the medium tray 603 such that the outer ends are located outside the medium tray 603. In other words, the first outer side guide 607*e* and the second outer side guide 607*f* are located outside the first inner side guide 607*c* and the second inner side guide 607*d* in the width direction A2 perpendicular to the medium conveying direction. Thus, the side guides 607 are located on the medium tray 603 so that the outer ends can be positioned from an inside of the medium tray 603 to an outside of the maximum width of the medium tray 603.

Similar to the first outer side guide 607*e* and the second outer side guide 607*f*, the first inner side guide 607*c* and the second inner side guide 607*d* may be formed with a permanent magnet or a ferromagnet, and may be attached to any position on the placing surface 603*a*. Further, similar to the placing surface 603*a*, a side surface of the medium tray 603 may be formed with a permanent magnet or a ferromagnet, and the first outer side guide 607*e* and the second outer side guide 607*f* may be attached to the side surface of the medium tray 203.

As described in detail above, the medium conveying apparatus can suitably convey the medium of various sizes, while suppressing an increase in the size of the medium tray, even when the side guides includes the inner side guide and the outer side guide.

Figure 13A:
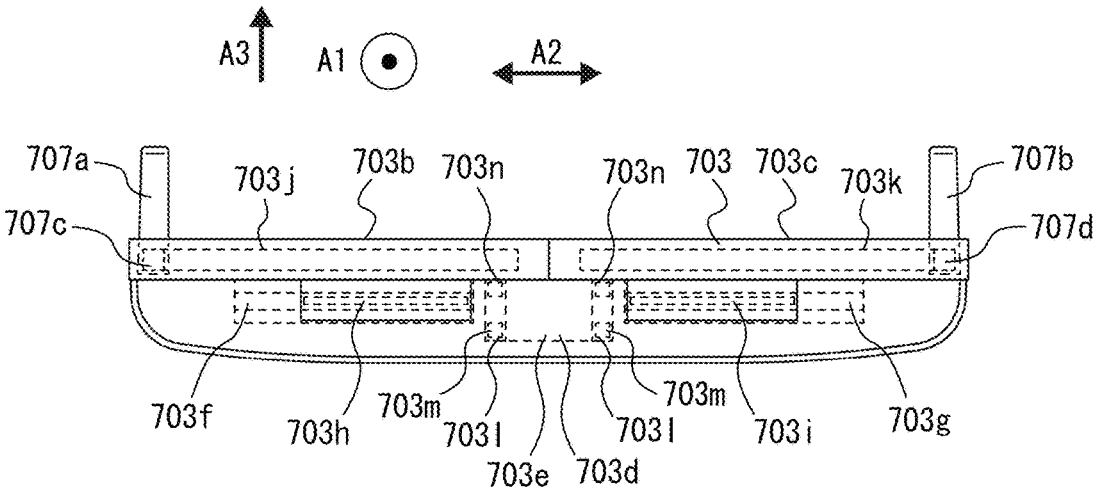
FIG. 13A is a schematic view for illustrating other side guides 707, etc.
Figure 13B:
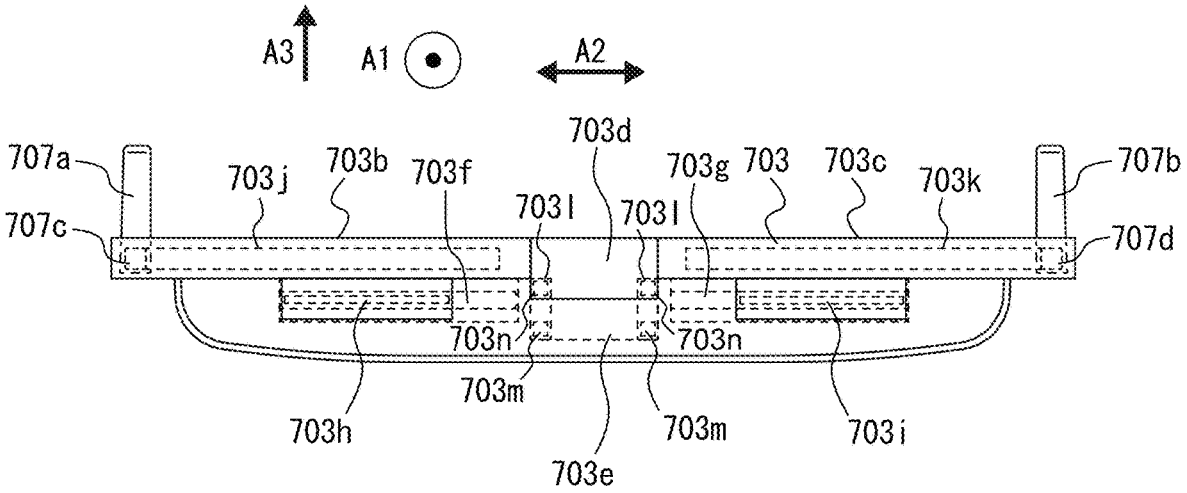
FIG. 13B is a schematic view for illustrating the other side guides 707, etc.

FIGS. 13A and 13B are schematic views illustrating the medium tray 703, the first side guide 707*a* and the second side guide 707*b* in a medium conveying apparatus according to another embodiment. FIG. 13A and FIG. 13B are side views of the medium tray 703 removed from the lower housing 101 from the downstream side. Hereinafter, the first side guide 707*a* and the second side guide 707*b* may be collectively referred to as side guides 707. The medium tray 703 and the side guide 707 are used in place of the medium tray 103 and the side guide 107 of the medium conveying apparatus 100, respectively.

The medium tray 703 includes a first mounting member 703*b*, a second mounting member 703*c*, a moving member 703*d*, and an accommodation portion 703*e*. A first guide part 703*f* and a second guide part 703*g* are formed in a lower part of the first placing member 703*b* and the second placing member 703*c* in the medium tray 703. The first guide part 703*f* and the second guide part 703*g* are rails formed to extend in the width direction A2. A first engaging portion 703*h* and a second engaging portion 703*i* are formed on lower surfaces of the first placing member 703*b* and the second placing member 703*c*. Further, a third portion 703*j* and a fourth guide portion 703*k* are formed on an upper surface of the first placing member 703*b* and the second placing member 703*c*. The third portion 703*j* and a fourth guide portion 703*k* are rails formed to extend in the width direction A2. Protrusions 703*l* are formed at the upstream and downstream ends of the moving member 703*d*. On the other hand, a lower recesses 703*m* are formed below the upstream and downstream ends of the accommodation portion 703*e*, and an upper recesses 703*m* are formed above the upstream and downstream ends of the accommodation portion 703*e*. On the other hand, the side guides 707 is located on the first placing member 703*b* and the second placing member 703*c*. A third engaging part 707*c* and a fourth engaging part 707*d* are formed in the side guides 707.

As shown in FIG. 13A, the moving member 703*d* is accommodated in the accommodating portion 703*e* by engaging the protrusions 703*l* with the lower recesses 703*m*.

Further, as shown in FIG. 13B, the first placing member 703*b* and the second placing member 703*c* slide on the mount 703, by moving the first engaging part 703*h* and the second engaging part 703*i* along the first guide part 703*f* and the second guide part 703*g*, respectively. In other words, the first placing member 703*b* and the second placing member 703*c* are movably provided in the width direction A4 perpendicular to the medium conveying direction. The moving member 703*d* is provided so that the moving member 703*d* is drawn upward from the accommodation part 703*e* to a substantial same height as the first placing member 703*b* and the second placing member 703*c*. The moving member 703*d* is locked to the position shown in FIG. 13B, by the moving member 703*d* pulled out, and the protrusions 703*l* engaged with the upper recesses 703*n*, in a state where the first placing member 703*b* and the second placing member 703*c* are located outside the moving member 703*d* in the width direction A2. In this manner, the moving member 703*d* is provided movable upward, inside the first placing member 703*b* and the second placing member 703*c* in the width direction A2. Since an upper surface of the moving member 703*d* pulled out from the accommodation portion 703*e* and upper surfaces of the first placing member 703*b* and the second placing member 703*c* are formed substantially flush with each other, a medium is suitably placed on the medium tray 703. The moving member 703*d* may be omitted when a distance between the first placing member 703*b* and the second placing member 703*c* located outermost in the width direction A2 is sufficiently short, since a medium placed on the medium tray 703 does not deflect.

On the other hand, as shown in FIGS. 13A and 13B, the side guides 707 slides on the first placing member 703*b* and the second placing member 703*c*, by moving the third engaging portion 707*c* and the fourth engaging portion 707*d* along the third guide portion 703*j* and the fourth guide portion 703*k*. Thus, the side guides 707 are located on the medium tray 703 so that the outer ends can be positioned from an inside of the medium tray 703 to an outside of the maximum width of the medium tray 703.

As described in detail above, the medium conveying apparatus can suitably convey media of various sizes while suppressing an increase in the size of the medium tray, even when the placing member in which the side guides 707 are located is movably provided in the width direction A2.

Figure 14A:
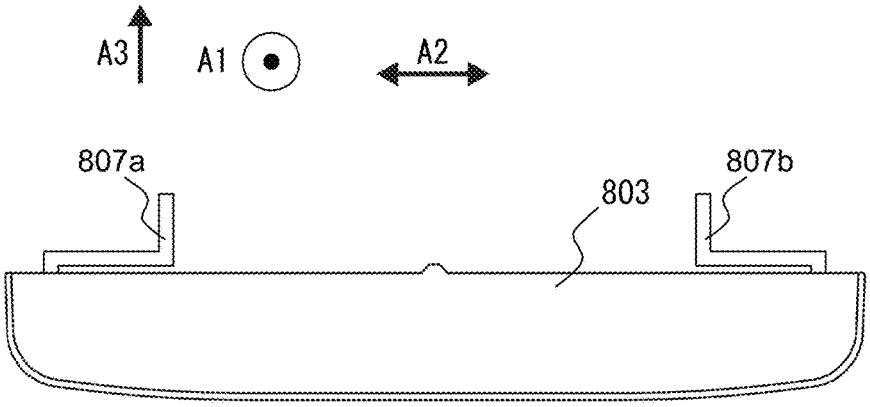
FIG. 14A is a schematic view for illustrating other side guides 807, etc.
Figure 14B:
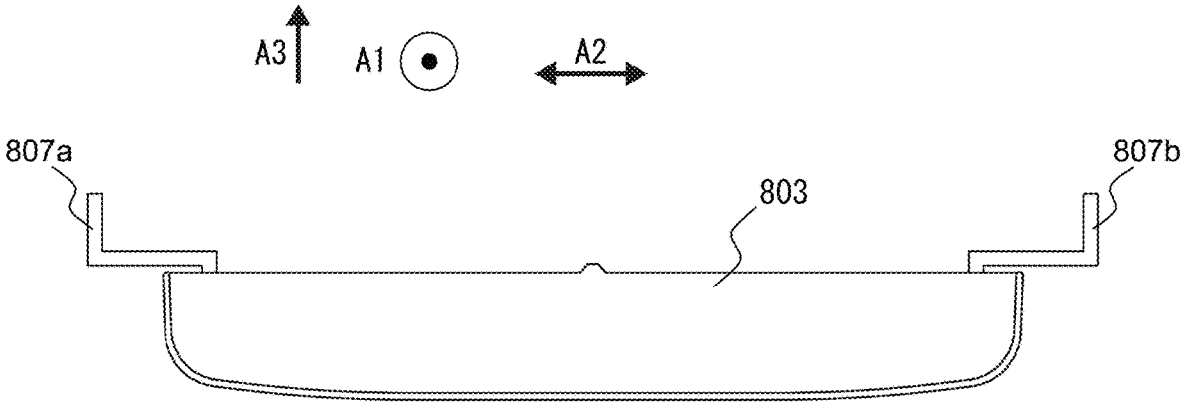
FIG. 14B is a schematic view for illustrating the other side guides 807, etc.

FIGS. 14A and 14B are schematic views illustrating the medium tray 803, the first side guide 807*a* and the second side guide 807*b* in a medium conveying apparatus according to another embodiment. FIGS. 14A and 14B are side views of the medium tray 803 removed from the lower housing 101 from the downstream side. Hereinafter, the first side guide 807*a* and the second side guide 807*b* may be collectively referred to as the side guide 807. The medium tray 803 and the side guide 807 are used in place of the medium tray 103 and the side guides 107 of the medium conveying apparatus 100, respectively.

Each of the side guides 807 is formed of a shape memory member such as a shape memory alloy. As shown in FIG. 14A, the side guides 807 can be installed to regulate a width direction of the medium inside the medium tray 803. Further, as shown in FIG. 14B, the side guide 807 can be installed to regulate the width direction of the medium outside the medium tray 803. Thus, the side guides 807 are located on the medium tray 803 so that the outer ends can be positioned from an inside of the medium tray 803 to an outside of the maximum width of the medium tray 803.

As described in detail above, the medium conveying apparatus can suitably convey media of various sizes, while suppressing an increase in the size of the medium tray, even when the side guides 807 are formed of shape memory members.

Figure 15A:
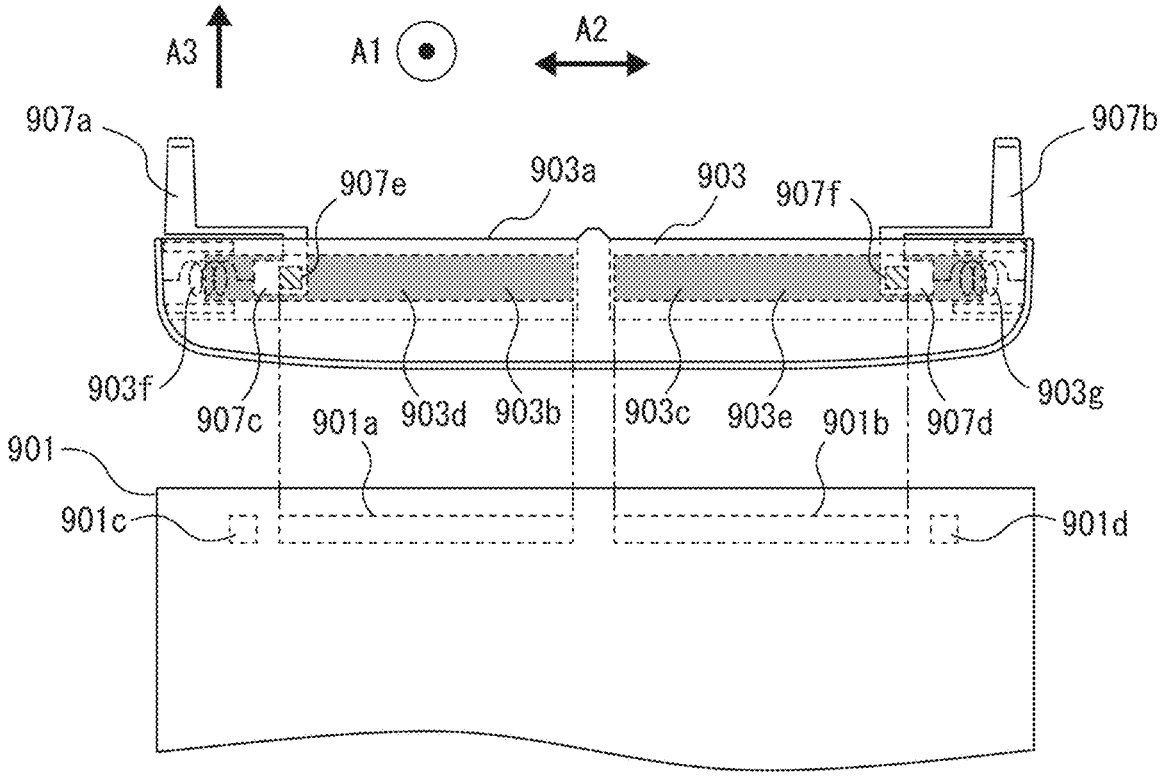
FIG. 15A is a schematic view for illustrating other side guides 907, etc.
Figure 15B:
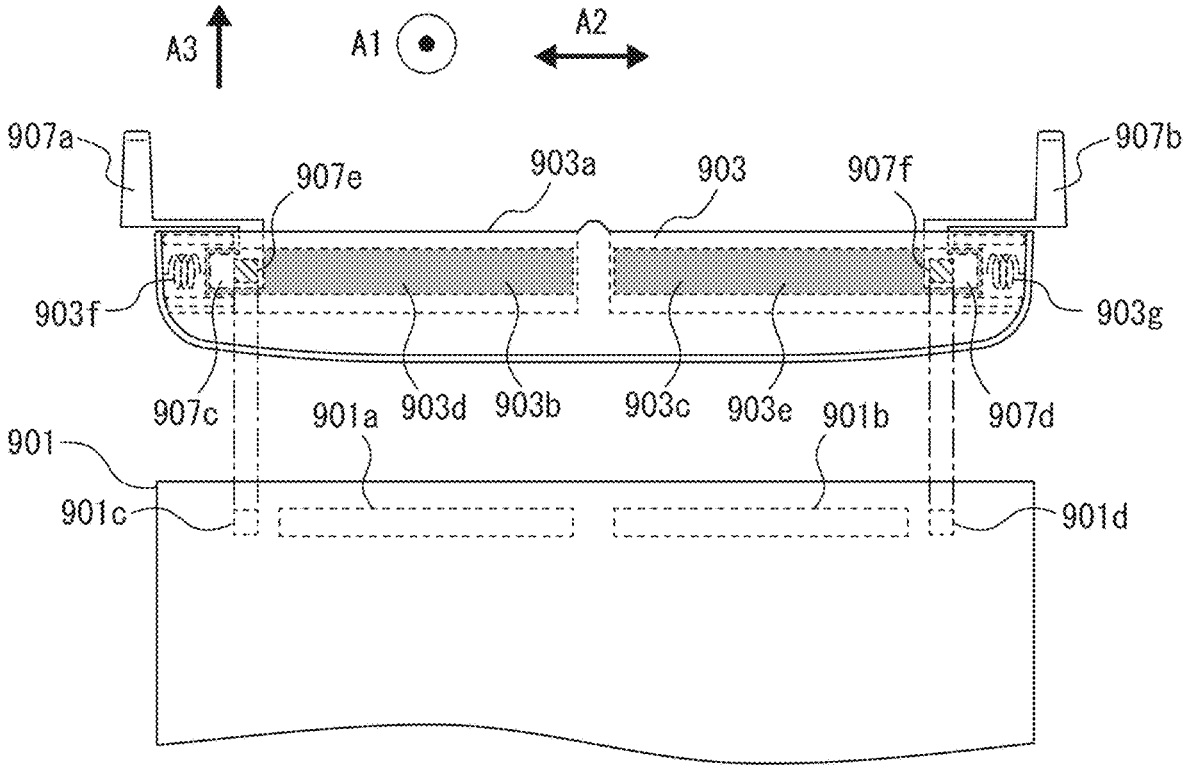
FIG. 15B is a schematic view for illustrating the other side guides 907, etc.

FIG. 15A and FIG. 15B are schematic views illustrating a lower housing 901, a medium tray 903, a first side guide 907*a* and a second side guide 907*b* in a medium conveying apparatus according to another embodiment. In FIGS. 15A and 15B, the upper view is a side view of the medium tray 903 removed from the lower housing 901 from the downstream side, and the lower view is a side view of the lower housing 901 from which the medium tray 903 is removed from the downstream side. Hereinafter, the first side guide 907*a* and the second side guide 907*b* may be collectively referred to as side guides 907. The lower housing 901, the medium tray 903 and the side guides 907 are used in place of the lower housing 101, the medium tray 103 and the side guides 107 of the medium conveying apparatus 100, respectively.

The lower housing 901 includes a first restricting portion 901*a*, a second restricting portion 901*b*, a first locking portion 901*c* and a second locking portion 901*d* on a surface facing the medium tray 903, i.e., a surface on which the medium tray 903 is attached. Each of the first restricting portion 901*a*, the second restricting portion 901*b*, the first locking portion 901*c* and the second locking portion 901*d* is a hole or a recess formed on a surface facing the medium tray 903.

The medium tray 903 is detachably provided from the lower housing 901. A first guide portion 903*b* and a second guide portion 903*c* are formed on a placing surface 903*a* of the medium tray 903. The first guide portion 903*b* and the second guide portion 903*c* are rails formed to extend in the width direction A2. Further, a first hole 903*d* and a second hole 903*e* are formed along the first guide portion 903*b* and the second guide portion 903*c* on a surface facing the lower housing 901, i.e., a surface attached to the lower housing 901, of the medium tray 903. Further, the medium tray 903 includes a first spring member 903*f* and a second spring member 903*g* at both ends in the width direction A2. The first spring member 903*f* and the second spring member 903*g* are an example of a pressing member. A rubber member may be used instead of the first spring member 903*f* and the second spring member 903*g* as the pressing member.

The side guides 907 include the first engaging portion 907*c* and the second engaging portion 907*d*. A first protrusion 907*e* and a second protrusion 907*f* are formed at the upstream and downstream ends of the first engaging portion 907*c* and the second engaging portion 907*d*. The first protrusion 907*e* and the second protrusion 907*f* are provided to protrude from the first hole 903*d* and the second hole 903*e* toward the downstream side.

As shown in FIG. 15A, the first protrusion 907*e* and a second protrusion 907*f* engage with the first restricting portion 901*a* and the second restricting portion 901*b*, when the medium tray 903 is attached to the lower housing 901 in a state where the side guides 907 is located inside the medium tray 903, the first protrusion 907*e* and a second protrusion 907*f* moves along the first restricting portion 901*a* and the second restricting portion 901*b* in the width direction A2. The first restricting portion 901*a* and the second restricting portion 901*b* are provided so that outer ends of the side guides 907 cannot move to an outside of the maximum width of the medium tray 903. In other words, the first restricting portion 901*a* and the second restricting portion 901*b* restrict a movement of the outer ends of the side guides 907 to the outside of the maximum width of the medium tray 903, in a state where the medium tray 903 is attached to the lower body 901. Further, the first spring member 903*f* and the second spring member 903*g* are provided so as not to press the first engaging portion 907*c* and the second engaging portion 907*d* in this case.

Thus, in an operating state where the medium tray 903 is attached to the lower housing 901, the side guides 907 are slidable only inside the medium tray 903. Therefore, the medium conveying apparatus prevents the side guides 907 from moving outside the medium tray 903 when the medium conveying apparatus is used by a user to convey only a medium having a width less than the reference width, thereby, can improve a convenience of the user.

When the medium tray 903 is removed from the lower housing 901 from this condition, the first protrusion 907*e* and the second protrusion 907*f* are separated from the first restricting portion 901*a* and the second restricting portion 901*b*, and the side guides 907 can move outside the medium tray 903. In this case, the first spring member 903*f* and the second spring member 903*g* press the first engaging portion 907*c* and the second engaging portion 907*d* toward the inside of the width direction A2. In other words, the first spring member 903*f* and the second spring member 903*g* press the side guides 907 when the outer ends are located outside the maximum width of the medium tray 903, inside the mount 903. As shown in FIG. 15B, the side guides 907 are located outside the medium tray 903 when a force towards an outside of the width direction A2 by the user, which is stronger than a pressing force by a first spring member 903*f* and a second spring member 903*g*, is applied.

when the medium tray 903 is attached to the lower housing 901 in a state where the side guides 907 are located outside the medium tray 903, the first protrusion 907*e* and the second protrusion 907*f* engage with the first locking portion 901*c* and the second locking portion 901*d*, and are locked by the first locking portion 901*c* and the second locking portion 901*d*. In other words, the first locking portion 901*c* and the second locking portion 901*d* lock the side guides 907 when the outer ends are positioned outside the maximum width of the medium tray 903, in a state where the medium tray 903 is attached to the lower housing 901.

When the medium tray 903 is removed from the lower housing 901 from this condition, the first protrusion 907*e* and the second protrusion 907*f* are separated from the first locking portion and the second locking portion 901*d*. In this case, the first spring member 903*f* and the second spring member 903*g* push the first engaging portion 907*c* and the second engaging portion 907*d* towards to an inside of the width direction A2, so that the side guide 907 automatically moves inside the medium tray 903. Since the user can return the side guides 907 to inside the medium tray 903 simply by removing the medium tray 903 from the lower housing 901, the medium conveying apparatus can improve the convenience of the user.

As described in detail above, the medium conveying apparatus can suitably convey media of various sizes while suppressing an increase in the size of the medium tray, even when the medium conveying apparatus limits the movement of the side guides 907 in a state where the medium tray 903 is attached to the lower housing 901.

The side guide 907 may be provided movable only on the placing surface 903*a* of the medium tray 903. In that case, the first restricting portion 901*a* and the second restricting portion 901*b* are provided so that the side guides 907 can move only within a predetermined limit area set on the placing surface 903*a* in the width direction A2. On the other hand, the first locking portion 901*c* and the second locking portion 901*d* are provided so that the side guides 907 are locked to an unrestricted region set outside the restricted region in the width direction A2.

According to the embodiment, the medium conveying apparatus can suitably convey media of various sizes while suppressing an increase in the size of the medium tray.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium conveying apparatus comprising:

a medium tray;

a pair of side guides to regulate a width direction of a medium; and a housing on which the medium tray is located and including a conveyance path capable of conveying the medium placed on the medium tray; wherein the pair of side guides are located on the medium tray so that outer ends of the pair of side guides can be positioned from an inside of the medium tray to an outside of a maximum width of the medium tray, and wherein the conveyance path can convey a medium having a width of an inside of the pair of side guides even when the outer ends of the pair of side guides are positioned outside the maximum width of the medium tray.

2. The medium conveying apparatus according to claim 1, further comprising an imaging device provided on the conveyance path of the housing, wherein an imaging range of the imaging device is separated from both ends of the conveyance path in a direction perpendicular to a medium conveying direction by a predetermined distance or more.

3. The medium conveying apparatus according to claim 1, wherein the pair of side guides are provided so that the outer ends of the pair of side guides can move from the inside of the medium tray to the outside of the maximum width of the medium tray in a direction perpendicular to a medium conveying direction.

4. The medium conveying apparatus according to claim 3, wherein the medium tray includes a cover to move in conjunction with a movement of the pair of side guides to an outside of the maximum width of the medium tray and support the pair of side guides positioned outside an outer end of the maximum width of the medium tray.

5. The medium conveying apparatus according to claim 3, wherein the medium tray is detachably provided with respect to the housing, and wherein the housing includes a restricting portion to restrict a movement of outer ends of the pair of side guides to an outside of the maximum width of the medium tray in a state where the medium tray is attached to the housing.

6. The medium conveying apparatus according to claim 5, wherein the medium tray includes a pressing portion to press the pair of side guides when the outer ends are located outside the maximum width of the medium tray, inside the medium tray, and wherein the housing includes a locking portion to lock the pair of side guides when the outer ends are positioned outside the maximum width of the medium tray, in a state where the medium tray is attached to the housing.

7. The medium conveying apparatus according to claim 1, wherein the pair of side guides are detachably provided with respect to the medium tray.

8. The medium conveying apparatus according to claim 1, wherein each of the pair of side guides includes an inner side guide movably provided in a direction perpendicular to a medium conveying direction on the medium tray, and an outer side guide located outside the inner side guide in a direction perpendicular to a medium conveying direction.

9. The medium conveying apparatus according to claim 8, wherein the inner side guide and the outer side guide are provided so that the inner side guide and the outer side guide are accommodated in the medium tray.

10. The medium conveying apparatus according to claim 8, wherein the medium tray includes a moving member which is movable upward, inside the inner side guide in a direction perpendicular to a medium conveying direction.

11. The medium conveying apparatus according to claim 1, wherein the medium tray includes a placing member on which the pair of side guides are located and movably provided in a direction perpendicular to a medium conveying direction.

* * * * *